US006701765B2

(12) United States Patent
Itaya

(10) Patent No.: US 6,701,765 B2
(45) Date of Patent: Mar. 9, 2004

(54) SPRING MANUFACTURING APPARATUS

(75) Inventor: Ichiro Itaya, Tokyo (JP)

(73) Assignee: Kabushiki Kaisha Itaya Seisaku Sho, Tokyo (JP)

( * ) Notice: Subject to any disclaimer, the term of this patent is extended or adjusted under 35 U.S.C. 154(b) by 0 days.

(21) Appl. No.: 09/905,122

(22) Filed: Jul. 13, 2001

(65) Prior Publication Data

US 2002/0108420 A1 Aug. 15, 2002

(30) Foreign Application Priority Data

Feb. 14, 2001 (JP) ..... 2001-037227

(51) Int. Cl.[7] ..... B21F 35/02

(52) U.S. Cl. ..... 72/137; 72/140; 72/441; 72/446

(58) Field of Search ..... 72/137, 138, 140, 72/403, 441, 442, 446

(56) References Cited

U.S. PATENT DOCUMENTS 873,429 A * 12/1907 Harter ..... 72/138
3,934,445 A * 1/1976 Lampietti ..... 72/129
5,127,247 A * 7/1992 Baisch ..... 72/138
5,937,685 A * 8/1999 Matsuoka et al. ..... 72/137
6,142,002 A * 11/2000 Itaya ..... 72/137
6,151,942 A * 11/2000 Itaya ..... 72/137

FOREIGN PATENT DOCUMENTS

| | | |
|---|---|---|
| JP | 5-84535 | 4/1993 |
| JP | 10-29028 | 2/1998 |
| JP | 2000-61736 | 2/2000 |
| JP | 2000-334531 | 12/2000 |
| JP | 2000-343166 | 12/2000 |

* cited by examiner

*Primary Examiner*—Allen Ostrager
*Assistant Examiner*—John S Goetz
(74) *Attorney, Agent, or Firm*—Merchant & Gould P.C.

(57) ABSTRACT

Tool units (400) are slid by crank mechanisms (409) which are arranged on the respective sides of a table (200), convert rotational motions into translational motions, and use servo motors as drive sources, and are supported to swing on the rear end portions of the tool units.

1 Claim, 35 Drawing Sheets

SPRING MANUFACTURING APPARATUS

FIELD OF THE INVENTION

The present invention relates to a spring manufacturing apparatus for manufacturing springs having various shapes by forcibly bending, curving, or winding wires to be formed into springs with tools while continuously feeding the wires.

BACKGROUND OF THE INVENTION

In a conventional spring manufacturing apparatus, tools are respectively driven/controlled by independent servo motors and placed at arbitrary angles around a wire.

The tool positions are, however, finely adjusted by a skilled operator by hunching in accordance with a desired spring shape. This operation is difficult to repeat, and hence is a most time-consuming operation.

SUMMARY OF THE INVENTION

The present invention has been made in consideration of the above problem, and has as its object to provide a spring manufacturing apparatus which can execute fine adjustments on the positions of a plurality of tools with respect to the wires fed out from the wire guides by automatic control with high accuracy in a short period of time.

In order to solve the above problem and achieve the above object, according to the present invention, there is provided a spring manufacturing apparatus for manufacturing a spring by feeding a wire to be formed into a spring out of an end portion of a wire guide, and forcibly bending, curving, or winding the wire by using a tool in a spring forming space near an end portion of the wire guide, wherein a plurality of tools are arranged to extend radially with respect to wires fed into the spring forming spaces, supported to be slidable toward the wires fed into the spring forming spaces, and supported to allow the end portions of the tools to simultaneously swing with respect to the wires fed out from the end portions of the wire guides.

As described above, according to the present invention, since a plurality of tools are supported to allow the end portions of the tools to simultaneously swing with respect to the wires fed out from the end portions of wire guides, fine adjustments on the positions of a plurality of tools with respect to the wires fed out from the wire guides can be simultaneously executed by automatic control with high accuracy in a short period of time.

Other features and advantages of the present invention will be apparent from the following description taken in conjunction with the accompanying drawings, in which like reference characters designate the same or similar parts throughout the figures thereof.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENT

An embodiment of the present invention will be described in detail below with reference to the accompanying drawings.

Note that the embodiment described below is an example of means of implementing the present invention, and can be modified and changed without departing from the spirit and scope of the invention.

Arrangement of Spring Manufacturing Apparatus

Figure 1:
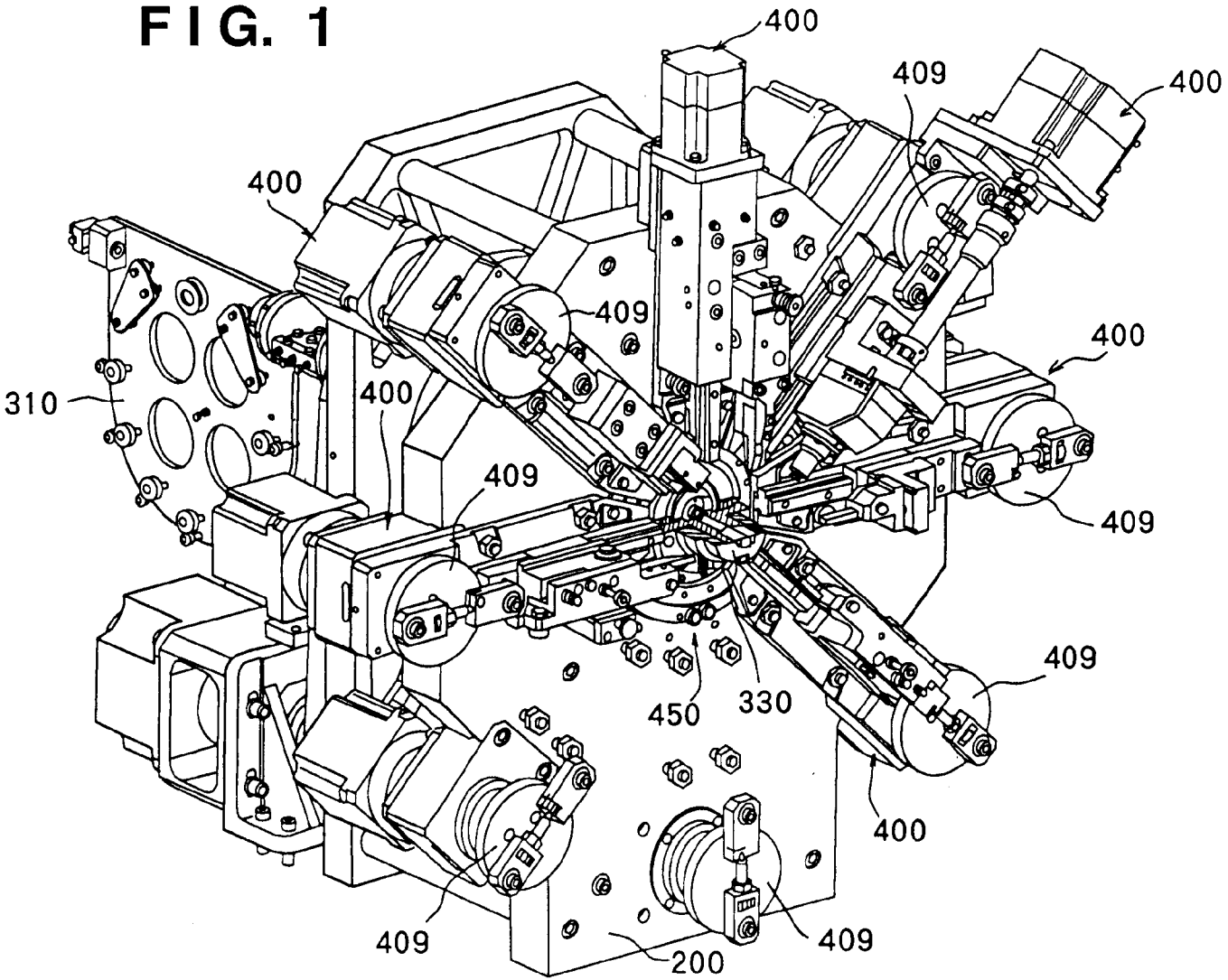
FIG. 1 is a perspective view showing the outer appearance of a spring manufacturing apparatus according to an embodiment when viewed from the front side.
Figure 2:
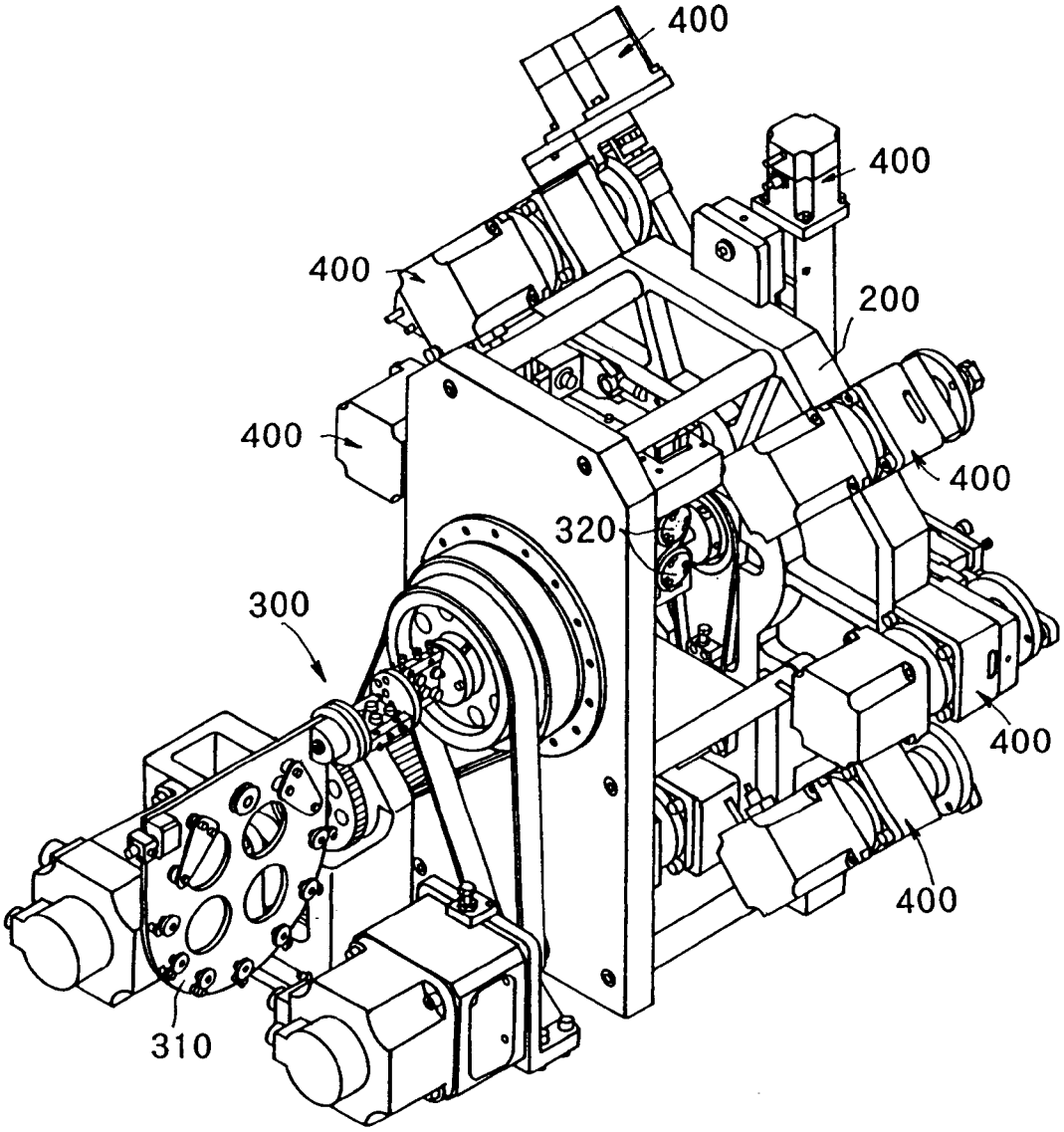
FIG. 2 is a perspective view showing the outer appearance of the spring manufacturing apparatus according to this embodiment when viewed from the rear side.
Figure 3:
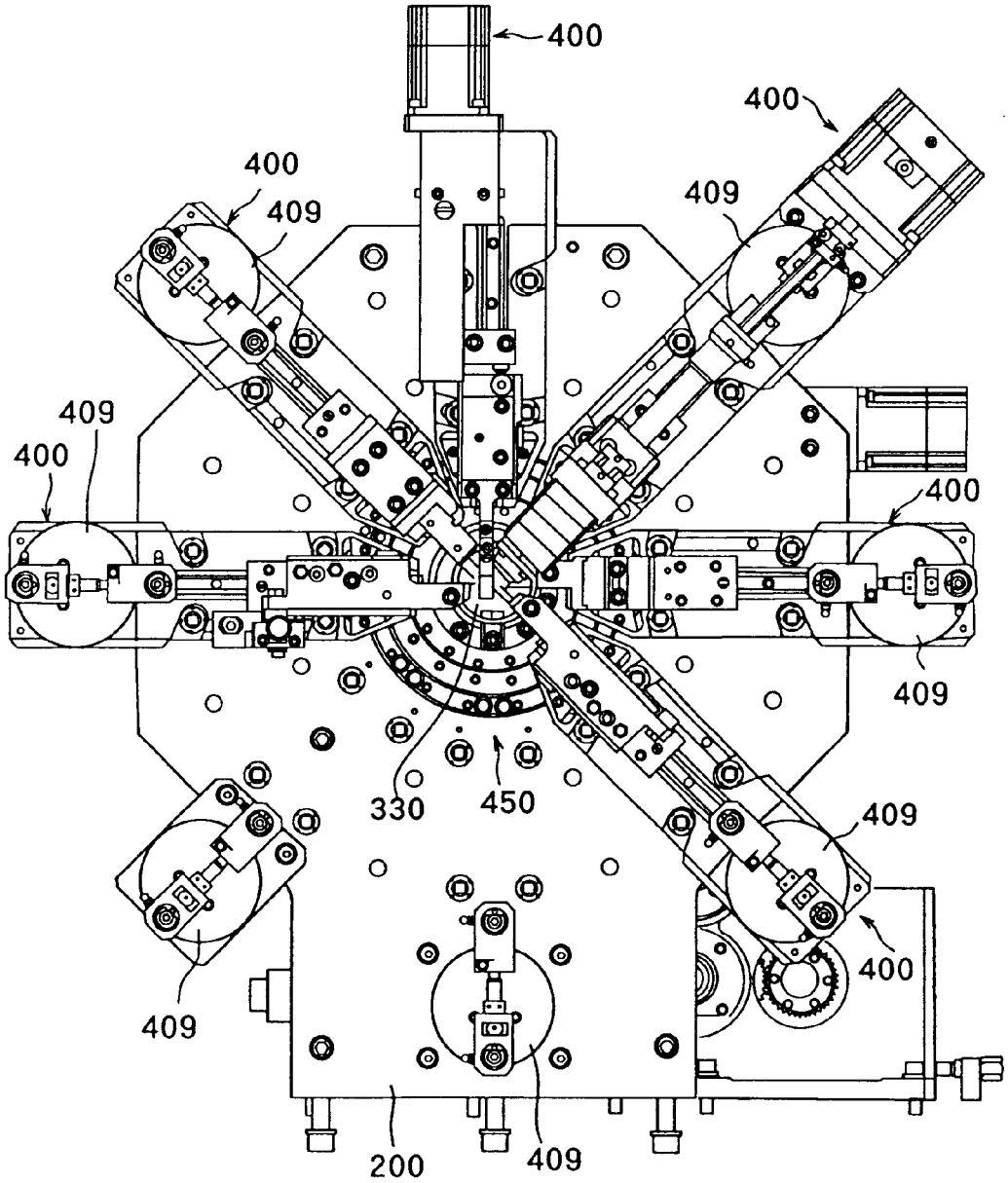
FIG. 3 is a front view showing the spring manufacturing apparatus according to this embodiment.
Figure 4:
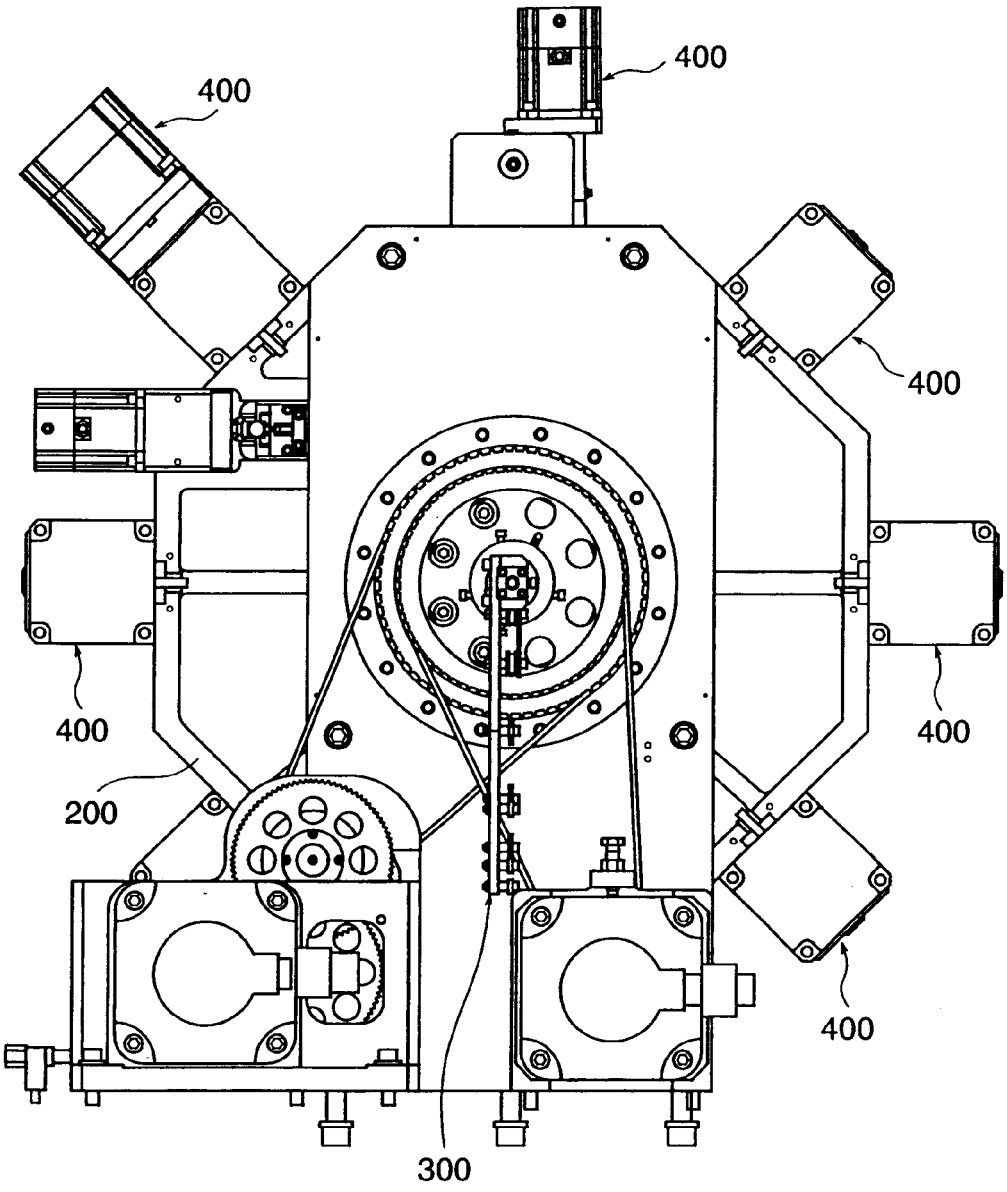
FIG. 4 is a rear view showing the spring manufacturing apparatus according to this embodiment.
Figure 5:
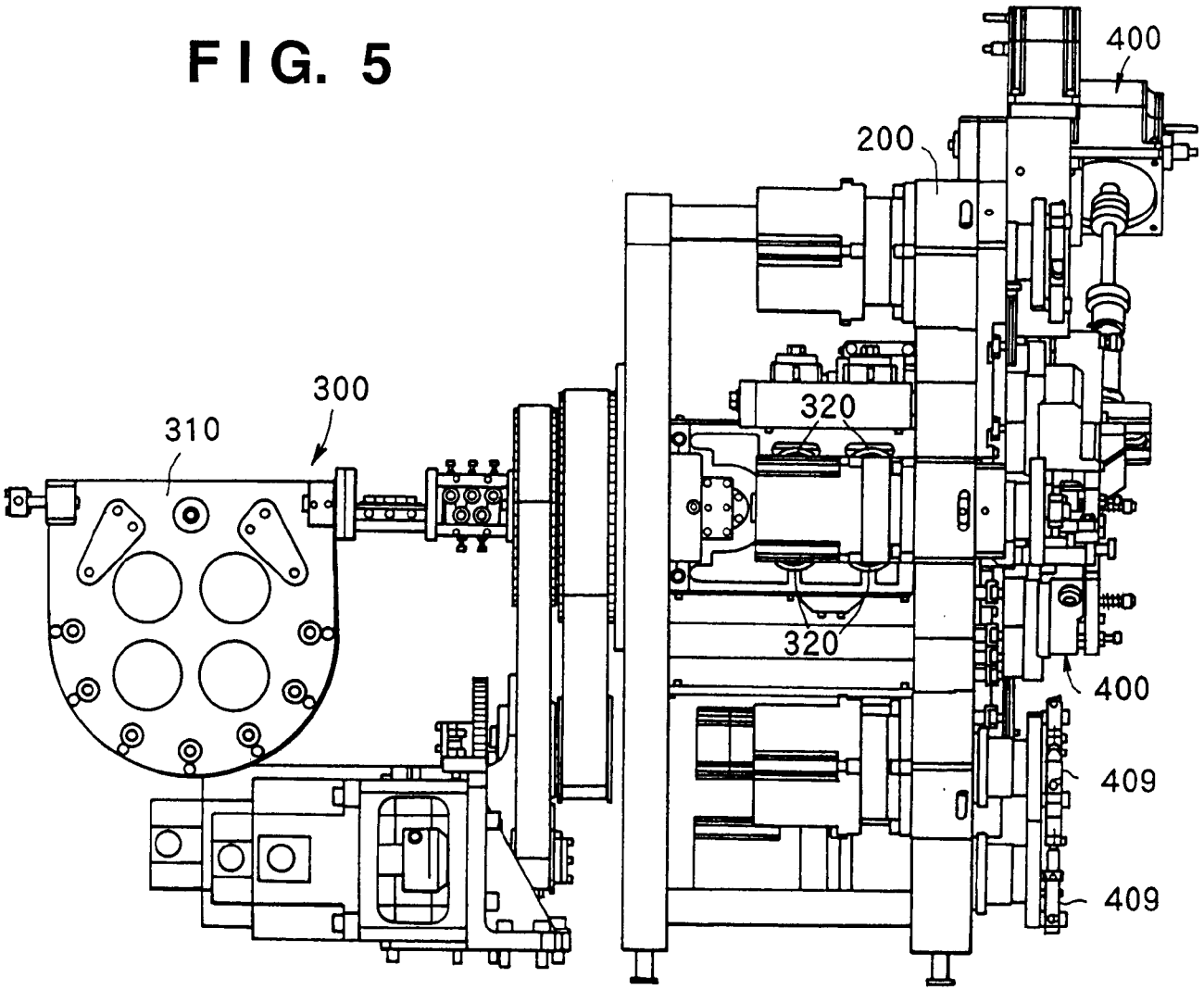
FIG. 5 is a side view showing the spring manufacturing apparatus according to this embodiment.

FIG. 1 is a perspective view showing the outer appearance of a spring manufacturing apparatus according to this embodiment when viewed from the front side. FIG. 2 is a perspective view showing the outer appearance of the spring manufacturing apparatus according to the embodiment when viewed from the rear side. FIG. 3 is a front view of the spring manufacturing apparatus according to the embodiment. FIG. 4 is a rear view of the spring manufacturing apparatus according to the embodiment. FIG. 5 is a side view of the spring manufacturing apparatus according to the embodiment.

As shown in FIGS. 1 to 5, the spring manufacturing apparatus according to this embodiment includes a regular octagonal table 200 which has an opening in its central portion and is mounted on a box-like base (not shown), a wire feeder 300 placed on the rear surface of the table 200, and a plurality of tool units 400 arranged on the front surface of the table 200 to extend radially around the opening (wire axis).

The wire feeder 300 includes a wire feed mechanism 310 for supplying a wire to be formed into a spring, a wire feed roller pair 320 for feeding the wire from the wire feed mechanism 310, and a wire guide 330 for guiding the wire pushed out by the wire feed roller pair 320 into a spring forming space.

The wire feed roller pair 320 feeds a wire out of the end portion of a wire insertion hole formed in the wire guide 330 by rotating each roller in the wire feed direction while clamping the wire with the pair of opposing rollers.

The wire feed roller pair 320 and wire guide 330 can rotate around the wire axis to twist a wire while clamping it with the pair of rollers.

The tool units 400, at least one tool unit, which form springs having desired shapes by forcibly bending, curving, winding, or cutting wires radially extend from the respective sides of the octagon of the table 200 toward the spring forming spaces while being arranged to be slidable along the wires fed into the spring forming spaces.

Each tool unit 400 is slid by a corresponding one of crank mechanisms 409 which are arranged at the respective sides of the table 200 to convert rotational motions into translational motions and use servo motors as driving sources, and are supported to swing on the rear end portions of the tool units. In addition, if the tool unit 400 has a rotating tool that rotates about a tool shaft, a servo motor for rotating the tool shaft is added as a driving source.

Tool Unit

Figure 6:
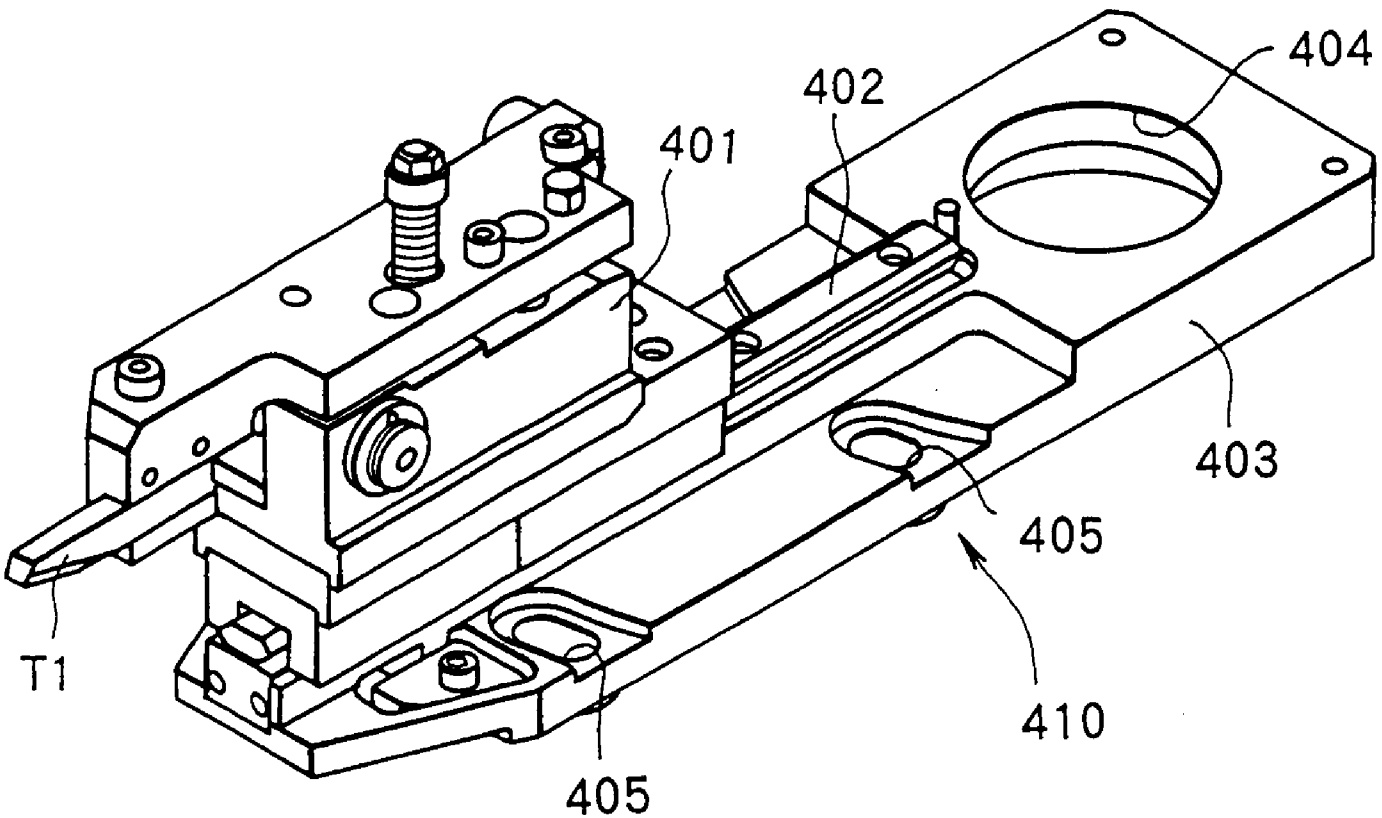
FIG. 6 is a perspective view showing the outer appearance of a curving tool unit.
Figure 7:
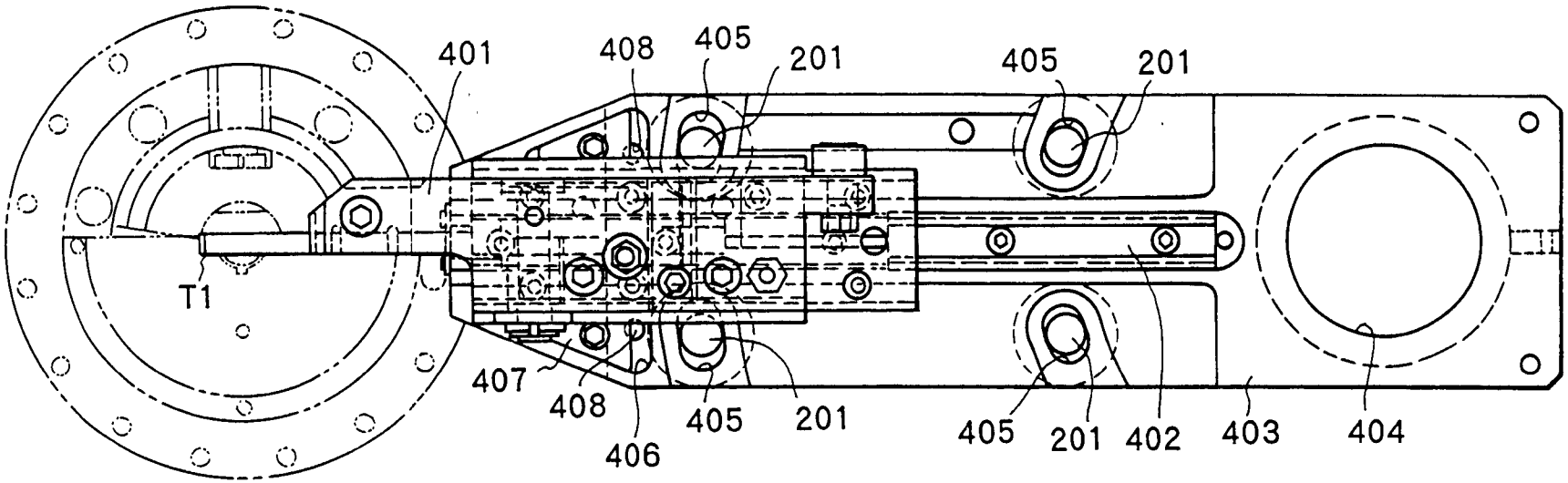
FIG. 7 is a plan view showing the curving tool unit.
Figure 8:
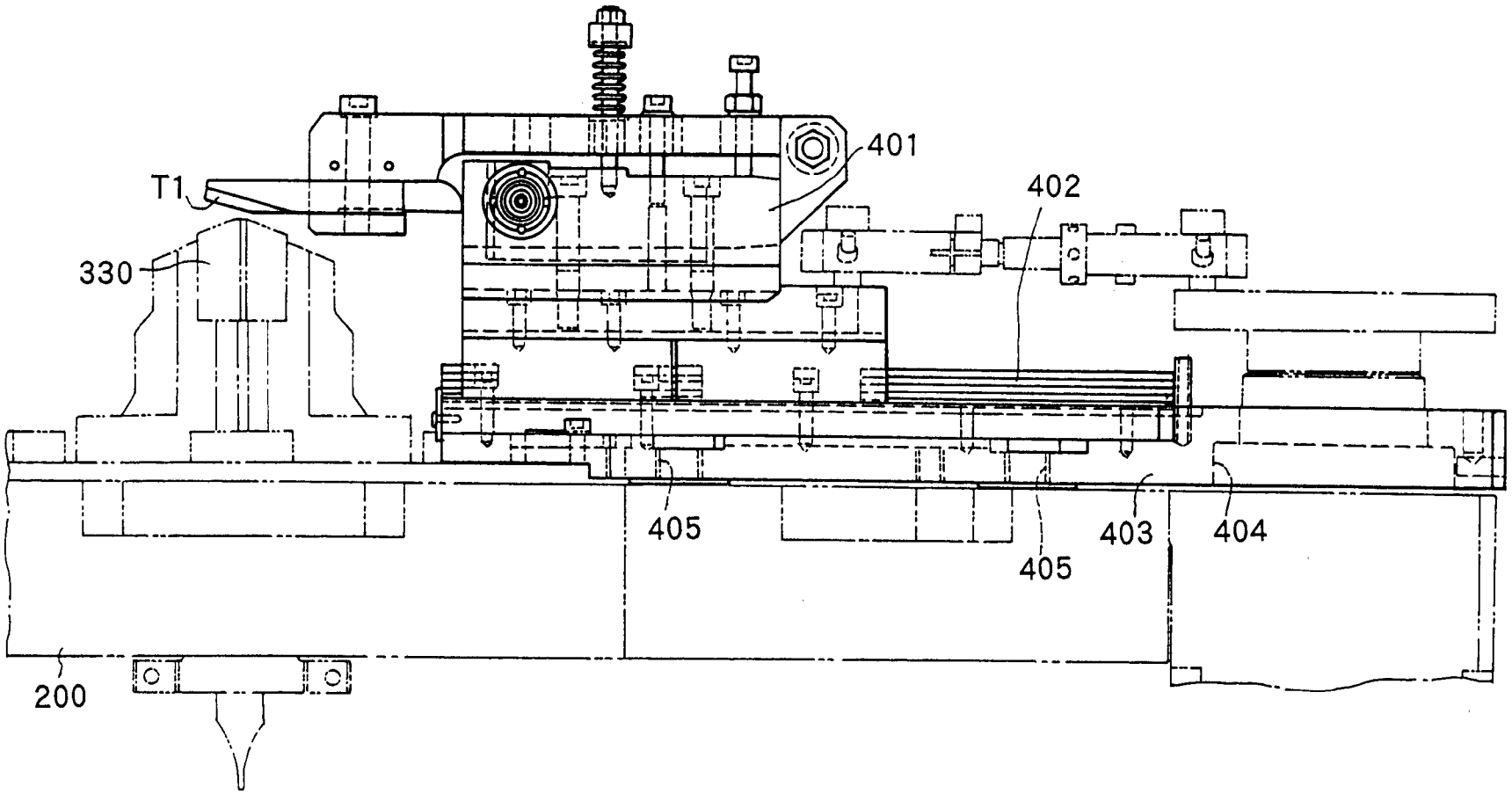
FIG. 8 is a side view showing the curving tool unit.
Figure 9:
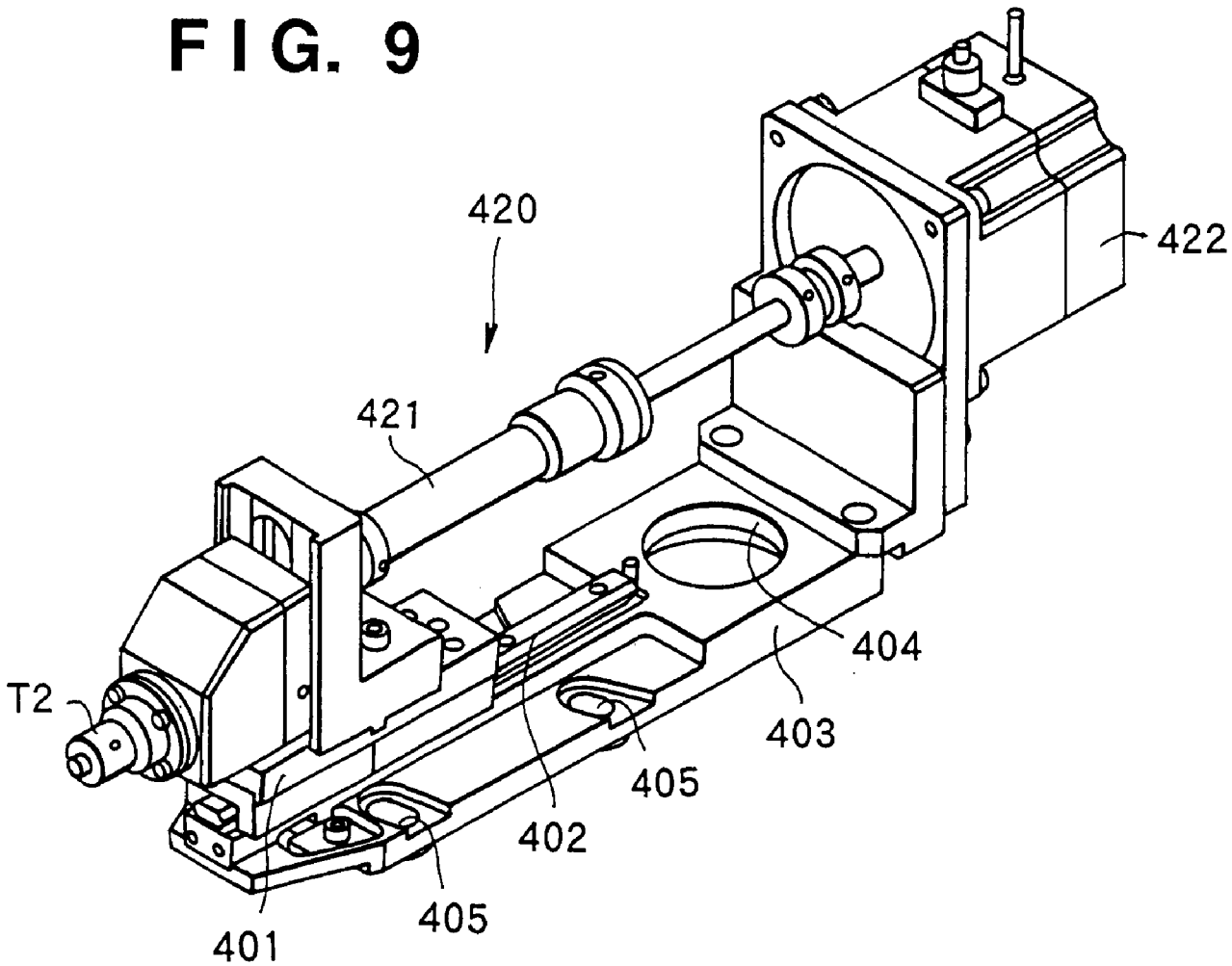
FIG. 9 is a perspective view showing the outer appearance of a rotating tool unit.
Figure 10:
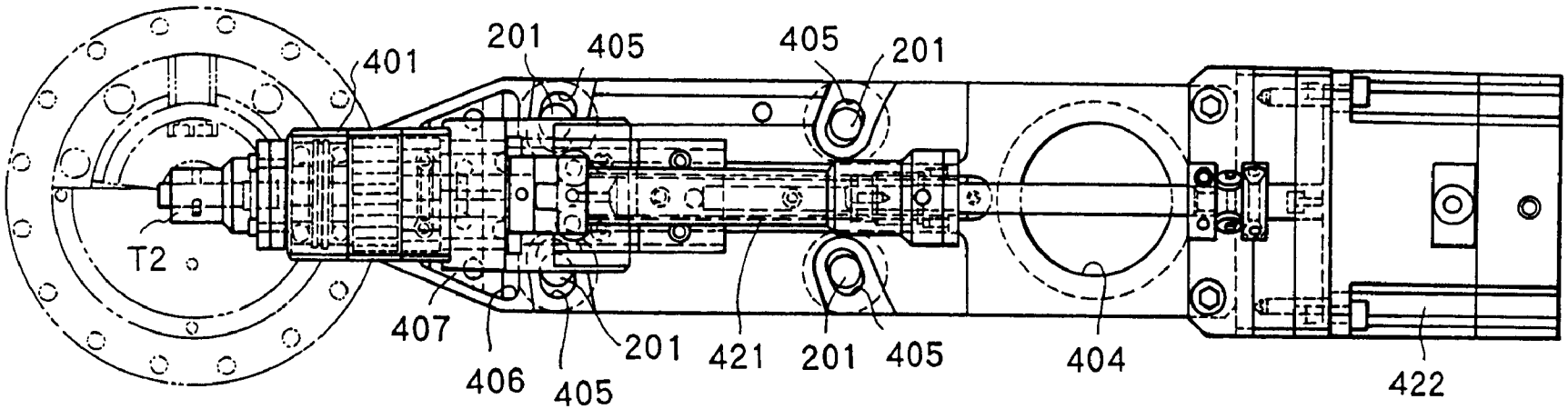
FIG. 10 is a plan view showing the rotating tool unit.
Figure 11:
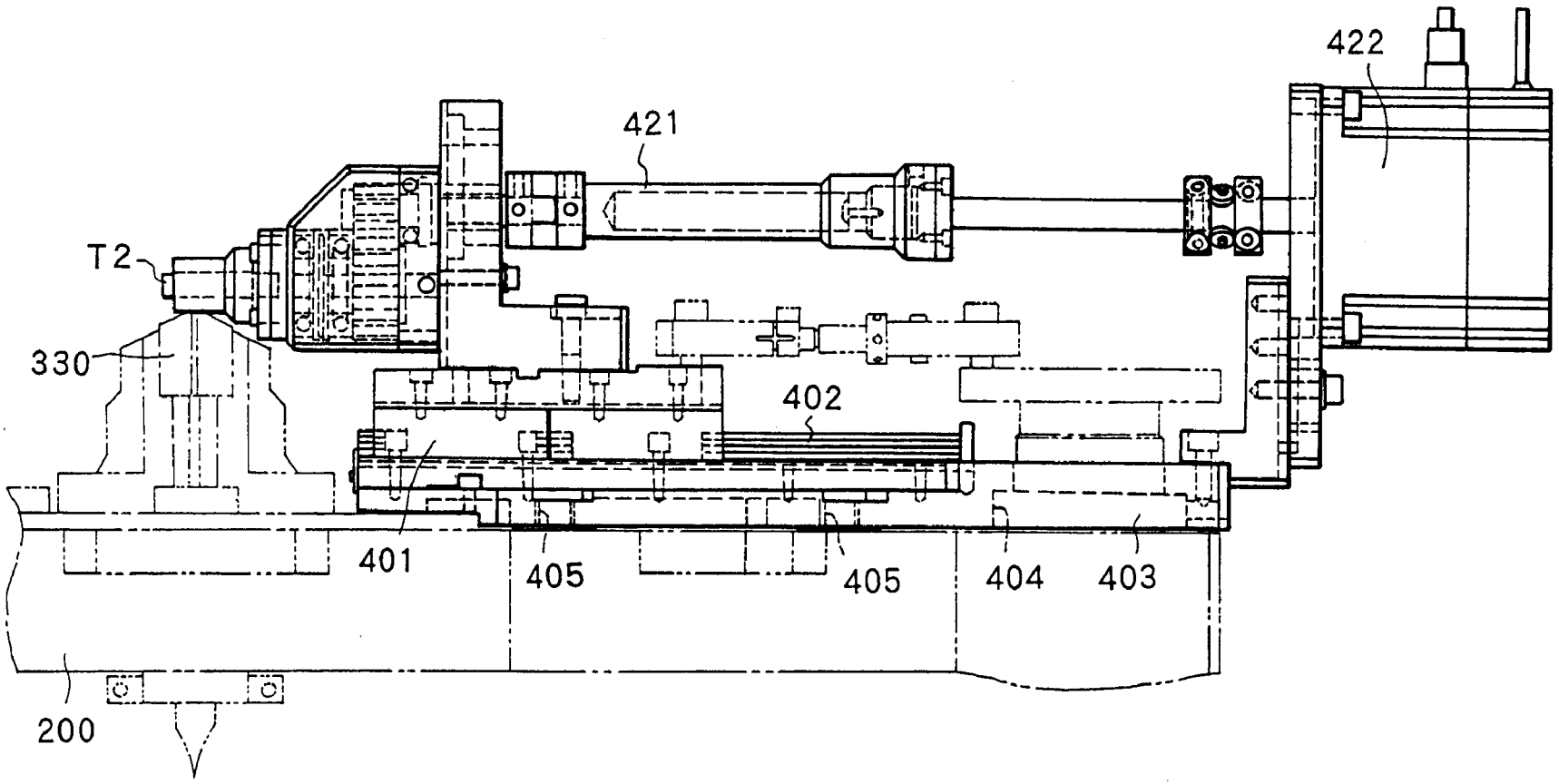
FIG. 11 is a side view showing the rotating tool unit.

A curving tool unit 410 for curving the wire fed out from the wire guide 330 as shown in FIGS. 6 to 8, a rotating tool unit 420 for winding the wire fed out from the wire guide 330 as shown in FIGS. 9 to 11, a cutting tool (not shown), and the like are mounted on the table 200.

Each tool unit 400 includes a slider 401 for holding tools T1 and T2, a slide rail 402 for axially supporting the slider 401 to allow it to freely slide or rotate around the tool shaft, and a slide base 403 for holding the slide rail 402. The rotating tool unit 420 has a rotating shaft 421 for rotating/driving the rotating tool T2 around the tool shaft while slidably supporting the rotating tool T2 with the slider 401, and a servo motor 422 for rotating/driving the driving shaft.

The slide base 403 is mounted on the front surface of the table 200 such that the slide base can rotate about a shaft hole 404 in which the slide mechanism is mounted, and the rotation is restricted by a plurality of elliptic rotation restricting holes 405 symmetrically formed in two side portions of the middle portion of the base. Protruding shafts formed on the table 200 at positions corresponding to the rotation restricting holes 405 are movably inserted therein.

A swing hole 406 for giving a driving force to the tool unit 400 to make it swing is formed in the end portion of the slide base 403 which is located on the spring forming space side. A roller mounted on a swing ring 450 (to be described later) is inserted into the swing hole 406 and clamped with a pair of bridges 407.

The end portion of the tool unit 400 which is located far from the wire fed out from the end portion of the wire guide 330 is rotatably supported by the shaft hole 404, whereas the end portion of the tool unit which is located near the wire is supported by the swing ring 450 which is rotated/driven at a predetermined angle around the wire fed out from the end portion of the wire guide 330.

The tool unit 400 is supported by the shaft hole 404, rotation restricting hole 405, swing hole 406, and swing ring 450 (to be described later) to swing at a predetermined angle around the wire fed out from the end portion of the wire guide 330.

Each of these tool units is detachably mounted on the table 200. The types, positions, and the like of tools can be arbitrarily set.

As the tool units 400, tools other than the above tools, e.g., a bending tool, holding tool, and cutting tool can be mounted.

Support Structure for Tool Unit

Figure 12:
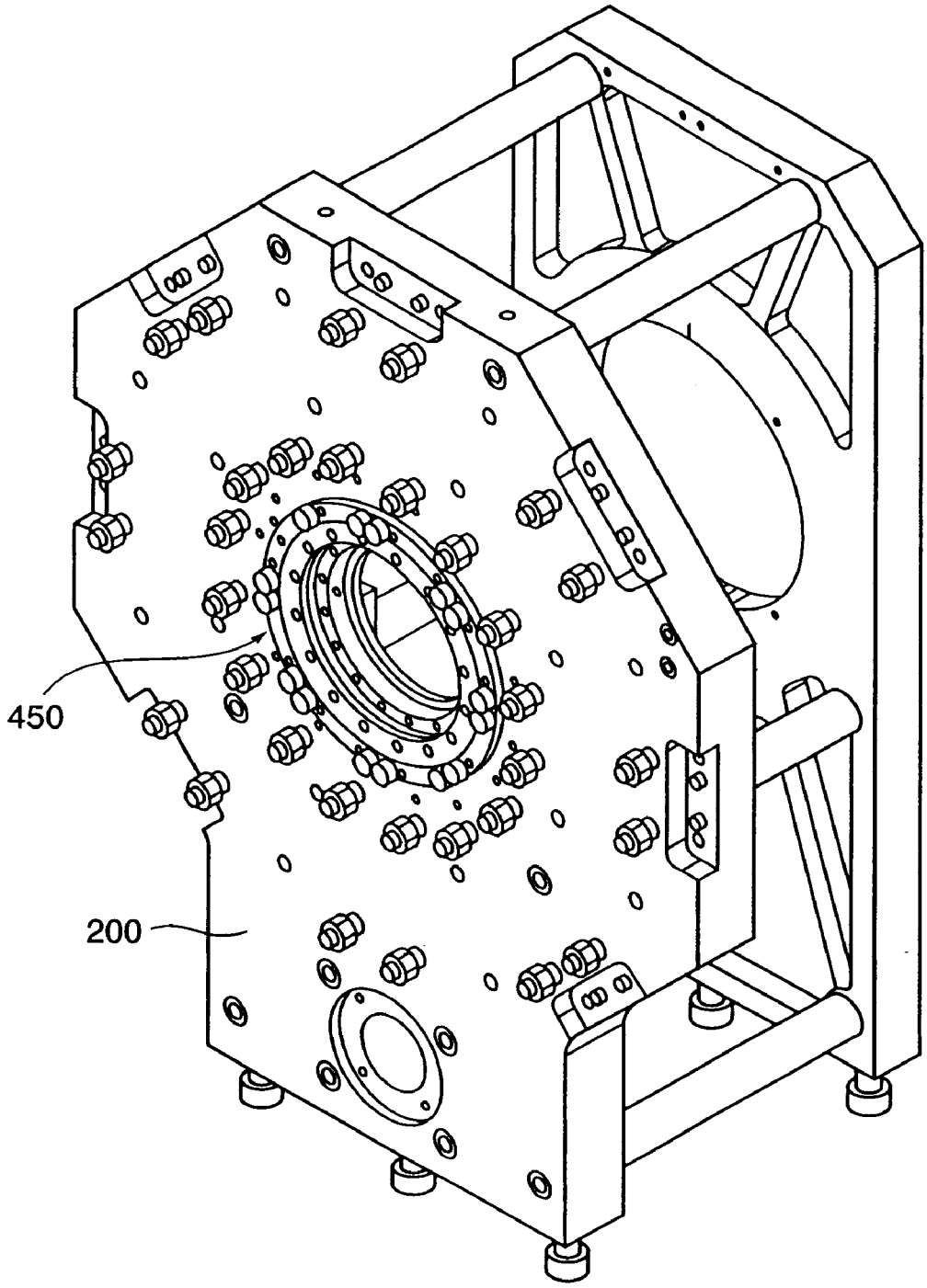
FIG. 12 is a perspective view showing the outer appearance of a table including a swing ring.
Figure 13:
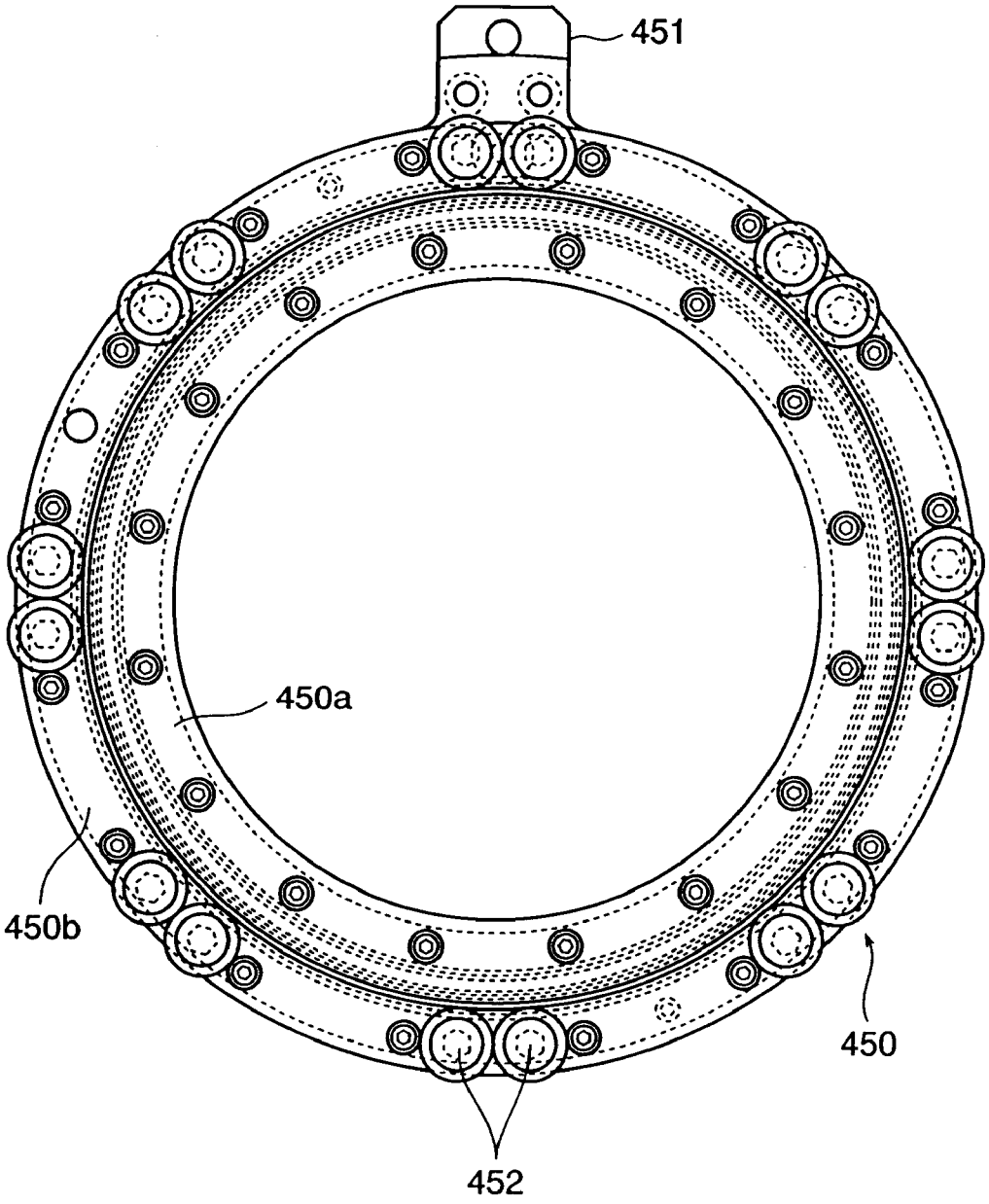
FIG. 13 is a front view showing the swing ring.

FIGS. 12 and 13 are views showing a swing support structure for each tool unit 400.

As shown in FIGS. 12 and 13, the annular swing ring 450 for swinging the tool unit 400 is rotatably mounted on the central portion of the table 200 to be centered on the wire, and has a protruding piece 451 protruding from a portion of its circumferential portion and a pair of swing rollers 452 that are mounted to correspond to the mounting position of the tool unit 400.

The swing ring 450 has an inner ring 450*a* and outer ring 450*b*. The inner ring 450*a* and outer ring 450*b* can rotate relative to each other. By fixing the inner ring 450*a* of the swing ring 450 on the central portion of the table 200, the outer ring 450*b* is rotatably supported.

The swing rollers 452 are axially supported on one side surface of the swing ring 450 to be rotatable.

Figure 14:
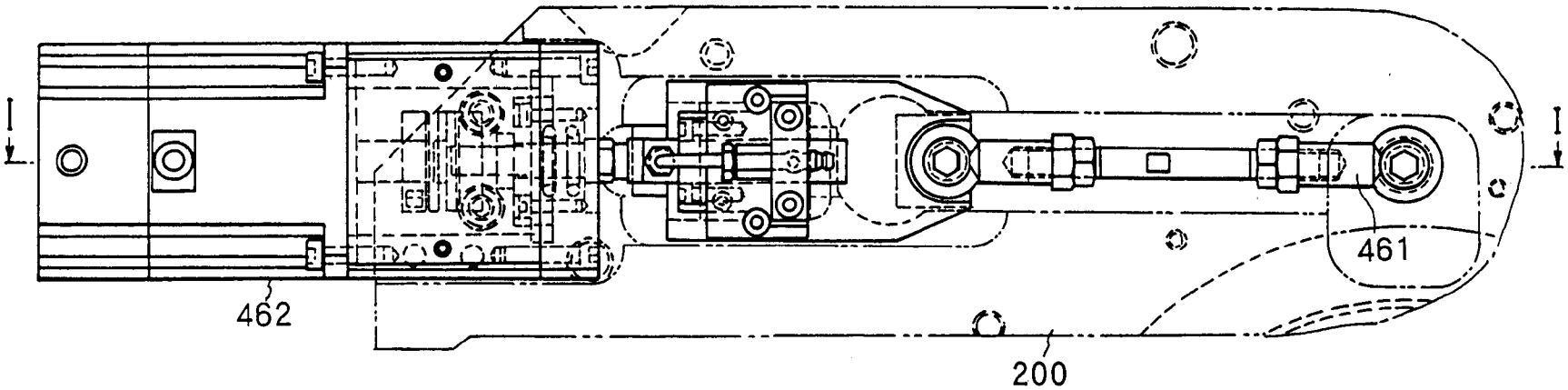
FIG. 14 is a plan view showing a driving mechanism for the swing ring.
Figure 15:
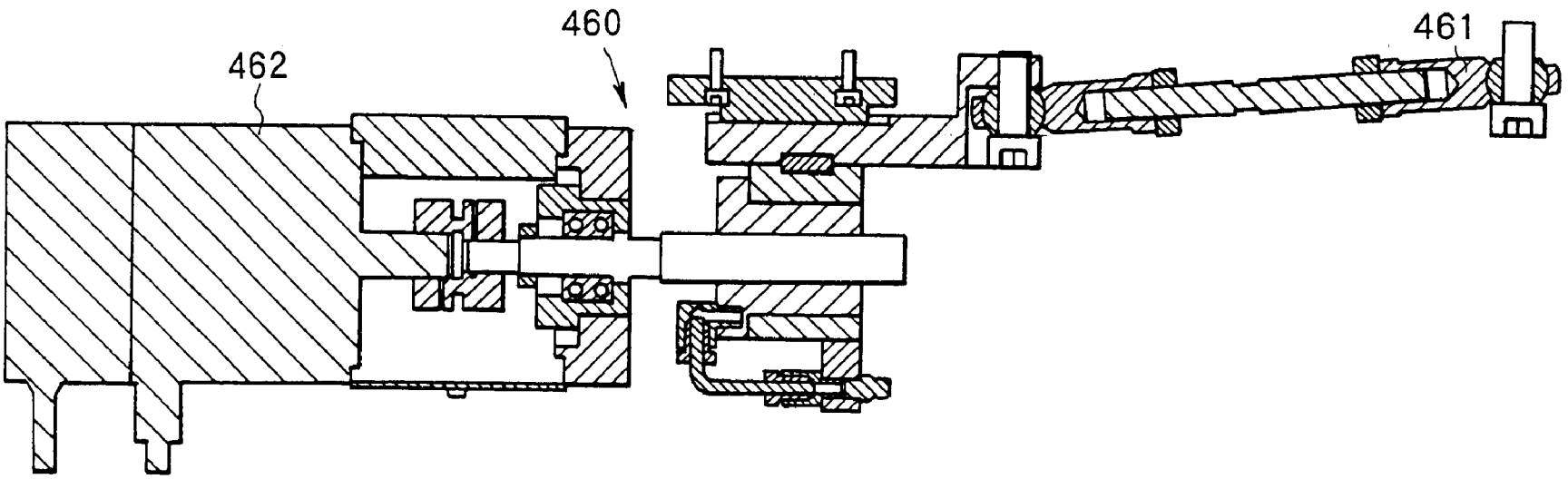
FIG. 15 is a sectional view taken along a line I—I in FIG. 14.

An arm 461 of a driving mechanism 460 placed on the rear surface of the table 200 as shown in FIGS. 14 and 15 is coupled to the protruding piece 451 of the swing ring 450. The swing ring 450 is pushed and pulled by a servo motor 462 to rotate within a restricted range. Upon rotation of this swing ring 450, the tool unit 400 swings at a predetermined angle around the wire fed out from the end portion of the wire guide 330.

The plurality of tool units 400, each having the swing rollers 452 clamped with the bridges 407 in the swing hole 406, simultaneously swing upon rotation of the swing ring 450. In addition, when the tool unit 400 is fixed in a bolt hole 408 upon removal of the bridges 407, the swing rollers 452 can freely move within the swing hole 406. In this arrangement, therefore, when the swing ring 450 rotates, the tool unit 400 does not swing. That is, by choosing between clamping the swing rollers 452 with the bridges 407 and not clamping them, all or some of the tool units 400 can be supported so as not to swing. This makes it possible to select tool units 400 which should swing simultaneously.

According to the above arrangement, the end portions of a plurality of tools are supported such that the tools simultaneously swing with respect to the wires fed out from the end portions of the wire guides. These tools can be driven by automatic control using motors. This makes it possible to simultaneously make fine adjustments on a plurality of tool positions with respect to the wires fed out from the wire guides by automatic control with high accuracy in a short period of time.

Example of Wire Forming by Various Tools

Figure 16:
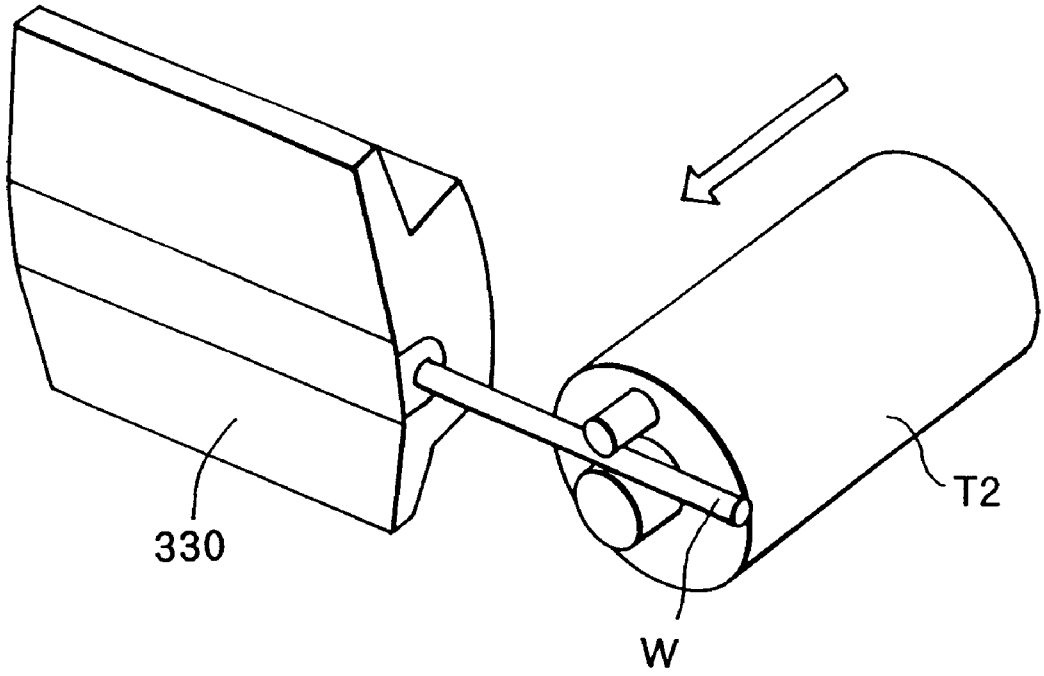
FIG. 16 is a view showing rotating tool bending in two-dimensional forming.
Figure 17:
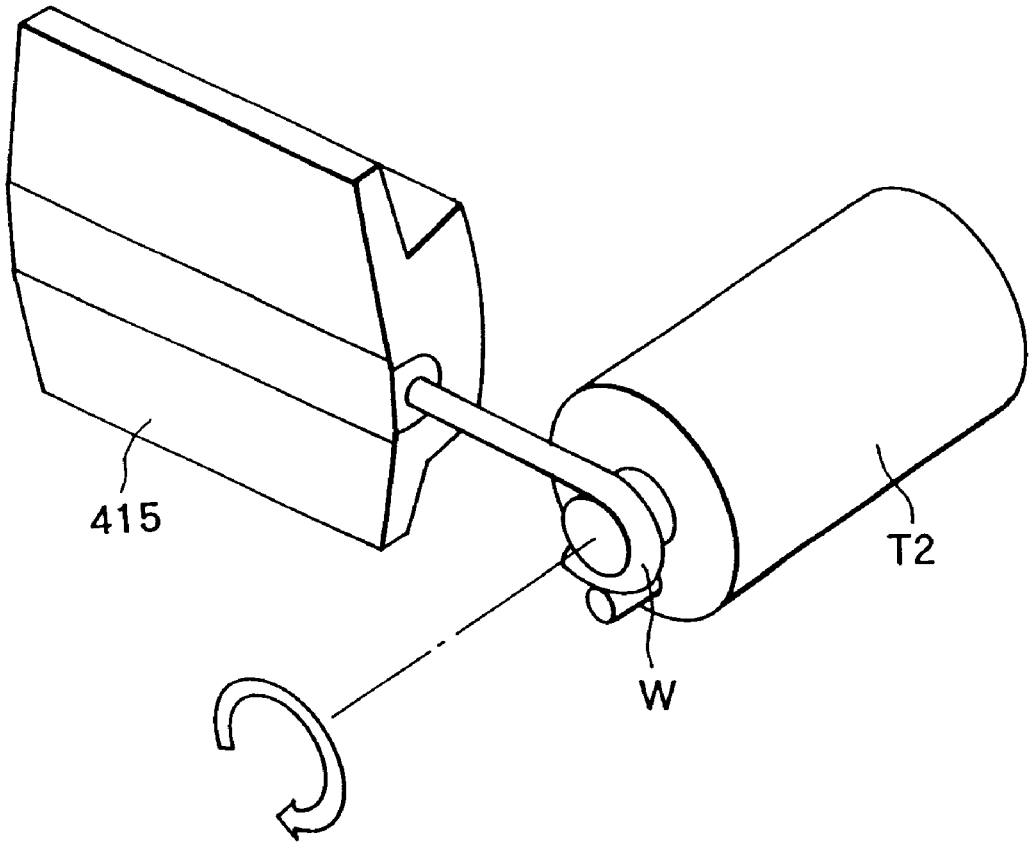
FIG. 17 is a view showing rotating tool bending in two-dimensional forming.

FIG. 16 and 17 show rotating tool bending in two-dimensional forming.

When rotating tool bending is to be performed in two-dimensional forming, the rotating tool T2 rotates in the bending direction of a wire W to bend the wire W with its end portion, thereby forming, for example, a hook portion of a spring. In this rotating tool bending, the wire can be bent without damaging it.

Figure 18:
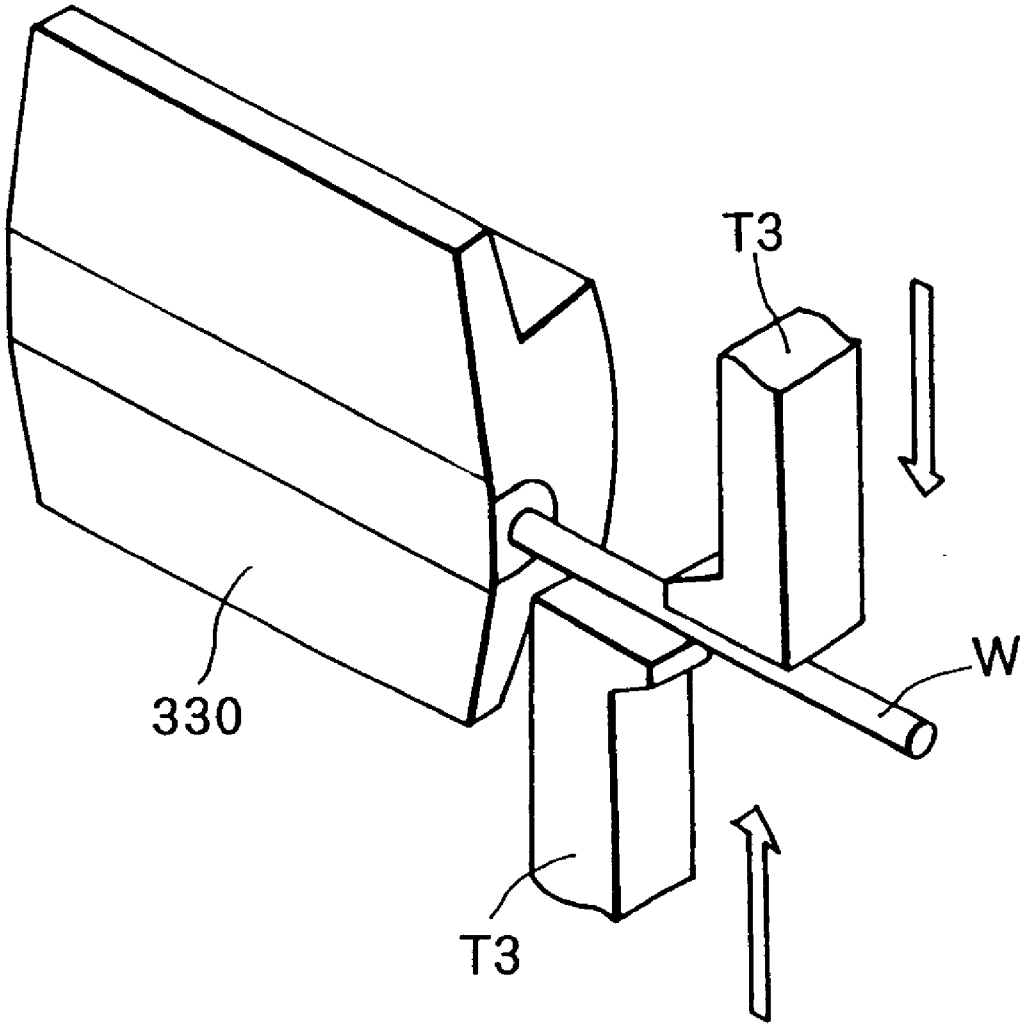
FIG. 18 is a view showing tool bending in two-dimensional forming.
Figure 19:
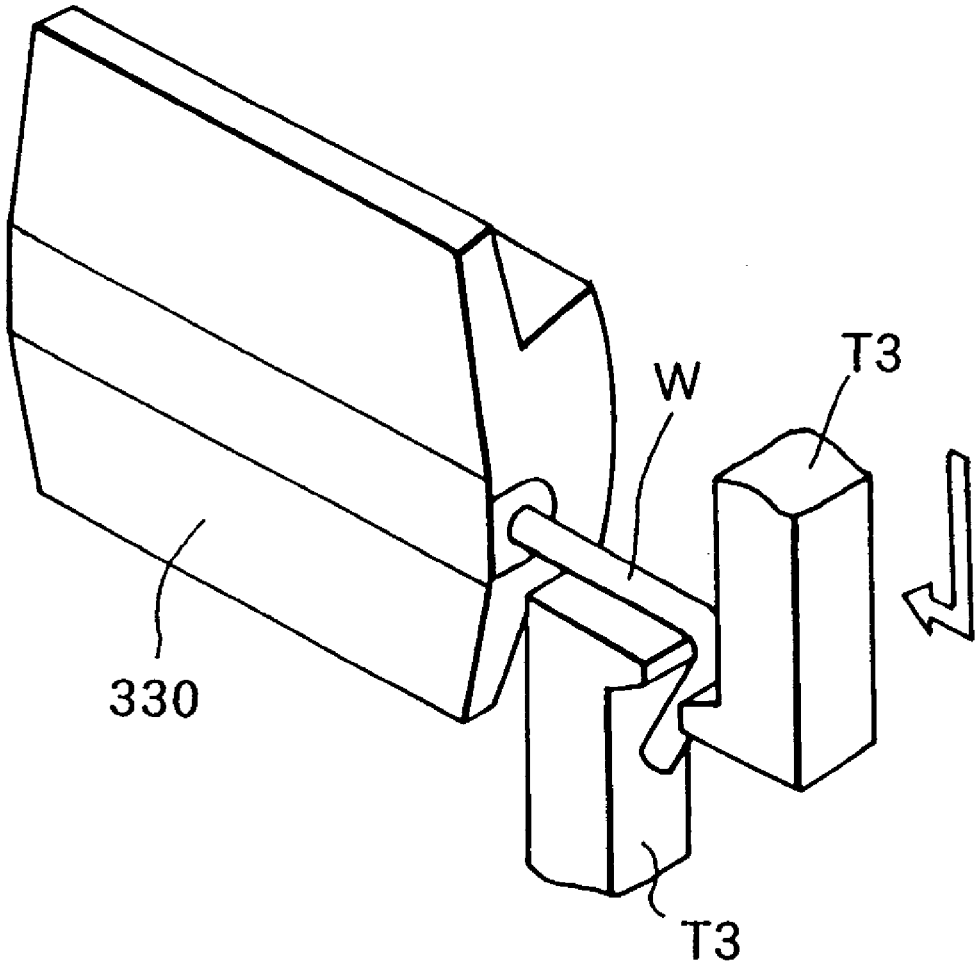
FIG. 19 is a view showing tool bending in two-dimensional forming.

FIGS. 18 and 19 show tool bending in two-dimensional forming.

When tool bending is to be performed in two-dimensional forming, opposing tools T3 are slid upward/downward by crank mechanisms to bend the wire W. This tool bending is used when there is no space for a rotating tool.

Figure 20:
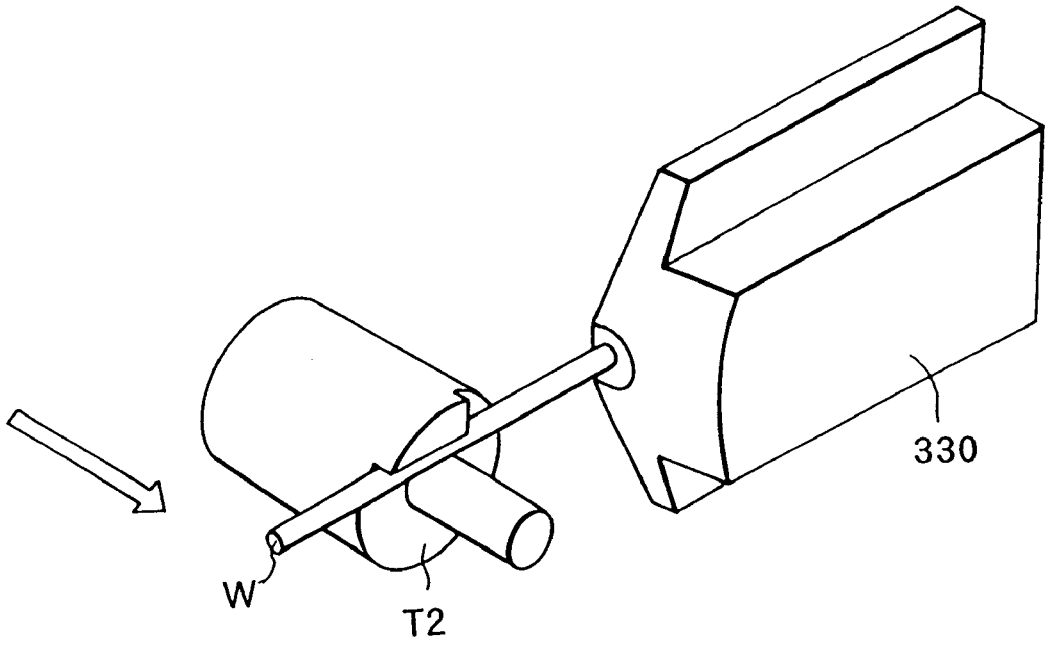
FIG. 20 is a view showing a rotating tool winding process in three-dimensional forming.
Figure 21:
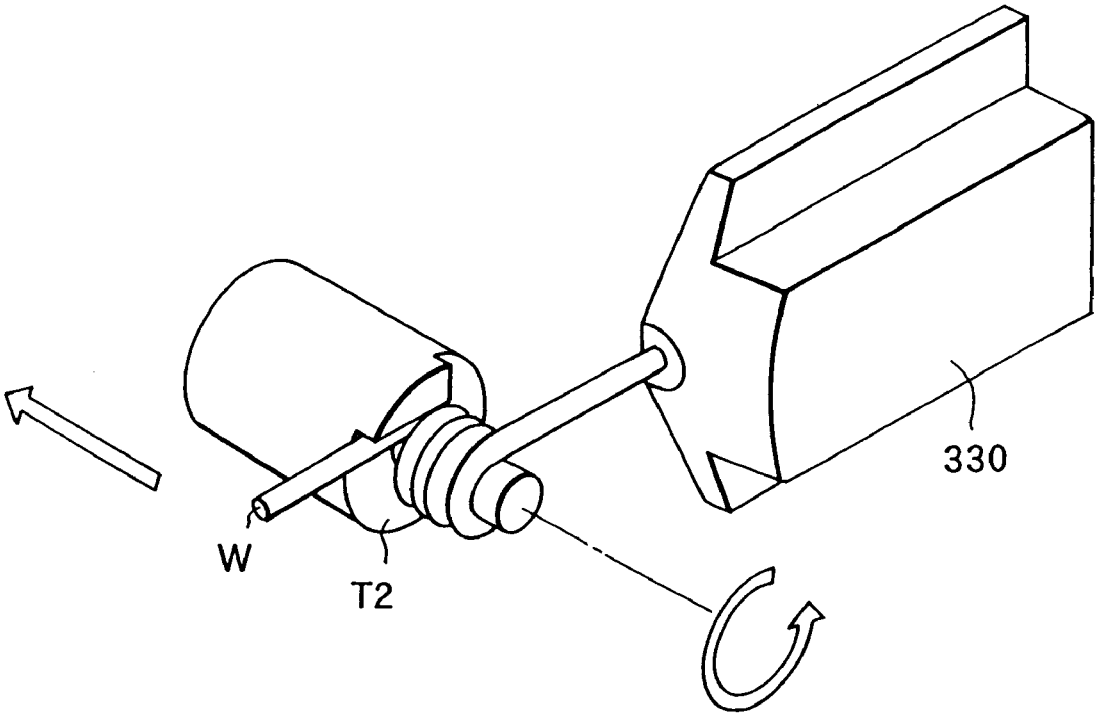
FIG. 21 is a view showing the rotating tool winding process in three-dimensional forming.

FIGS. 20 and 21 show a rotating tool winding process in three-dimensional forming.

When a rotating tool winding process is to be performed in three-dimensional forming, the rotating tool T2 rotates to wind the wire W around its end portion to form, for example, a coil portion of a spring. This rotating tool winding process can form a spring with a small ratio of the coil outer diameter to the wire diameter. This process can realize a high-precision coil inner diameter, in particular, and is suited to clutch springs and the like. In addition, the process is suited to forming of wires having cross-sections other than round cross-sections (e.g., wires having rectangular cross-sections).

Figure 22:
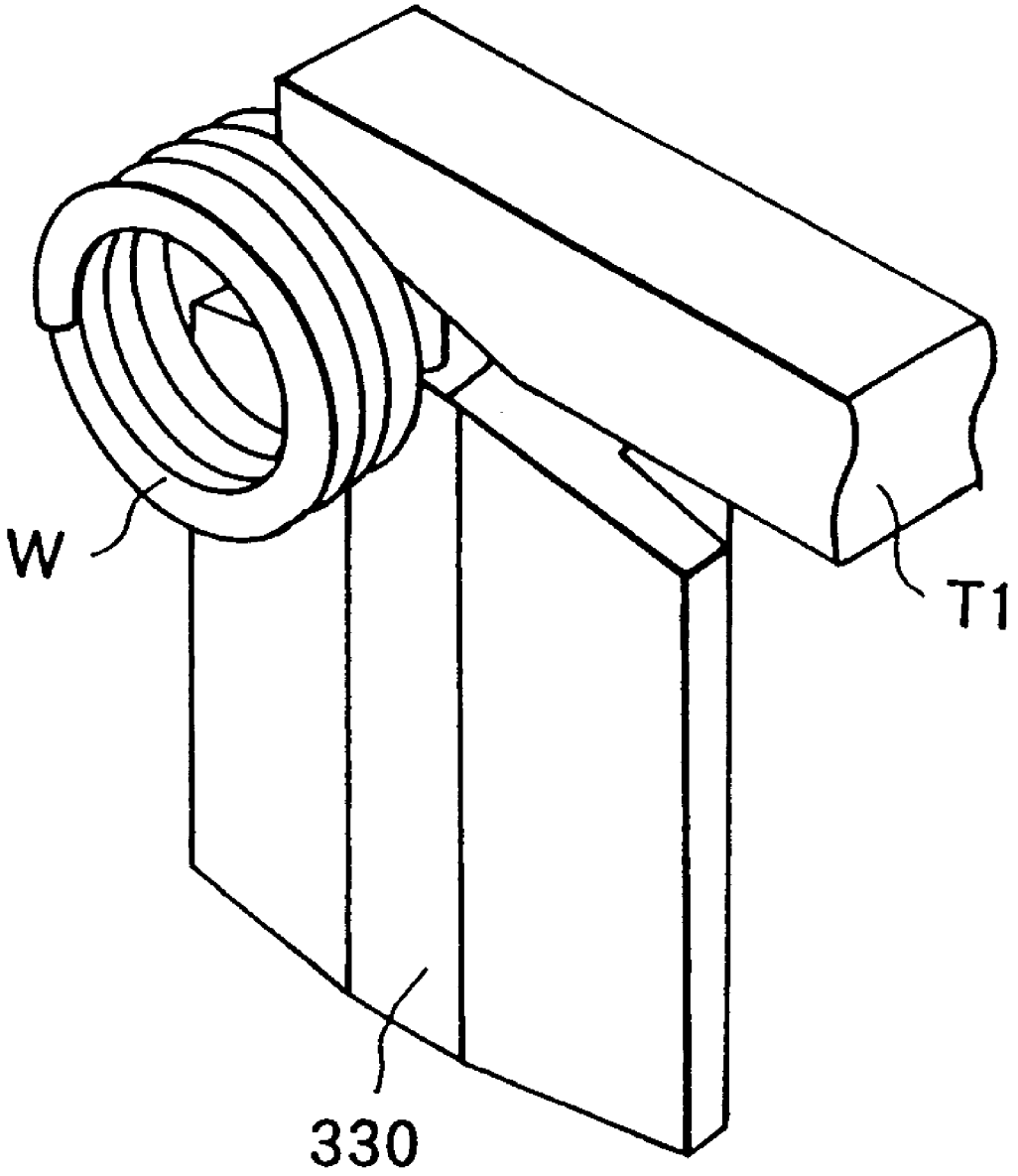
FIG. 22 is a view showing a coiling process in three-dimensional forming.
Figure 23:
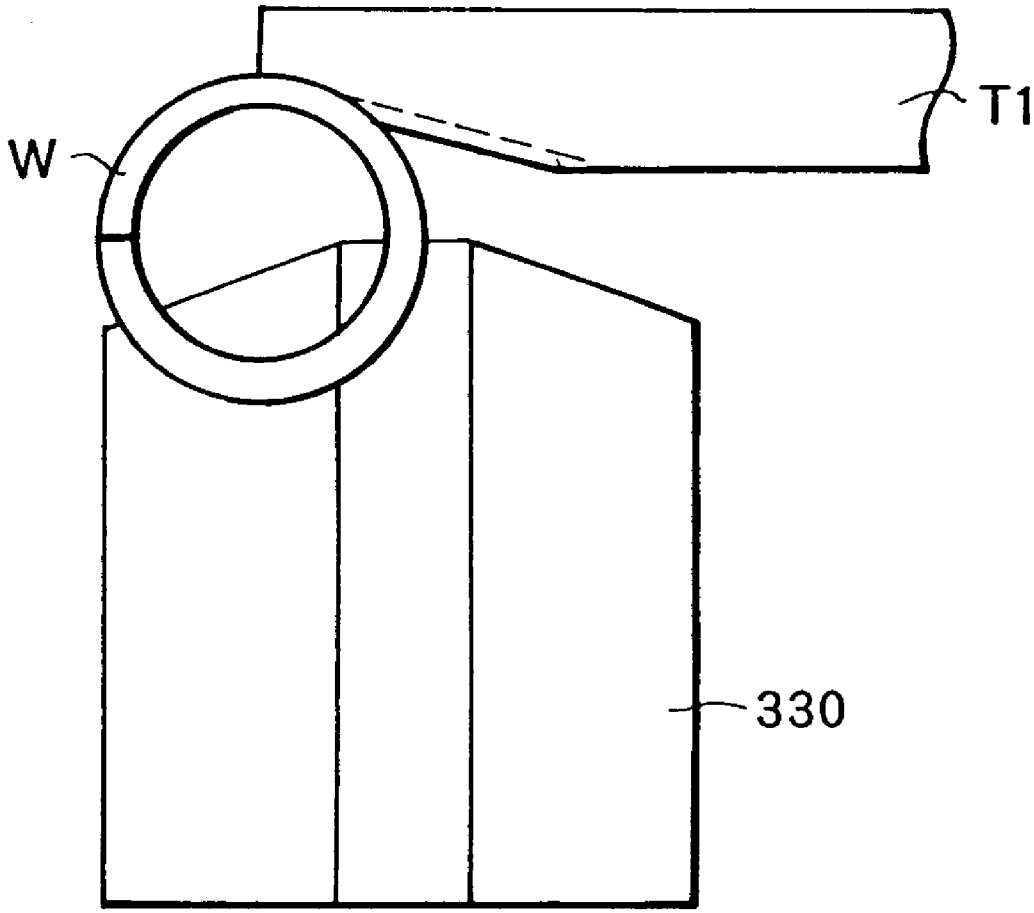
FIG. 23 is a view showing the coiling process in three-dimensional forming.

FIGS. 22 and 23 show coiling in three-dimensional forming.

When coiling is to be performed in three-dimensional forming, the wire W is pushed out to forcibly bring it into contact with the end portion of the abutment tool T1 and wind it on the inclined surface of the wire guide 330, thereby forming, for example, a coil portion of a spring. This coiling process can easily change the outer diameter of a coil and facilitate control on the winding angle of the coil. In addition, by changing the groove position of the end portion of the abutment tool T1, an initial tensile force and pitch can be easily set.

Figure 24:
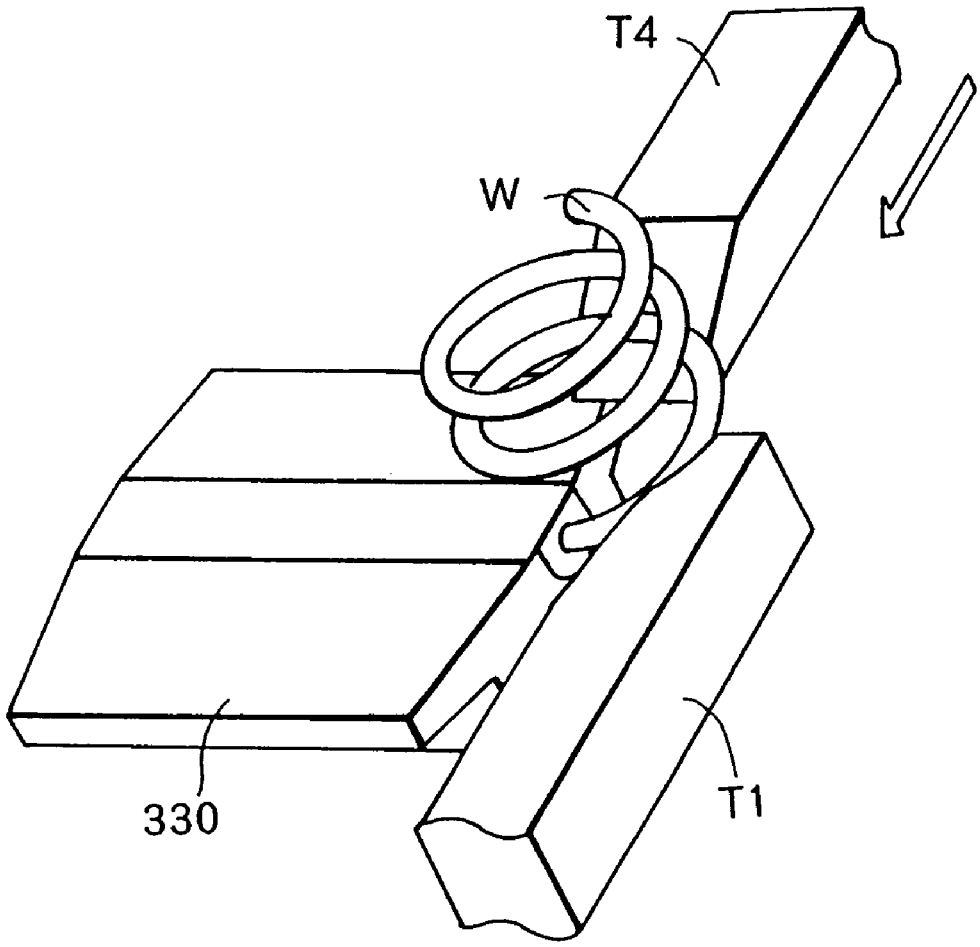
FIG. 24 is a view showing a pitched coiling process in three-dimensional forming.
Figure 25:
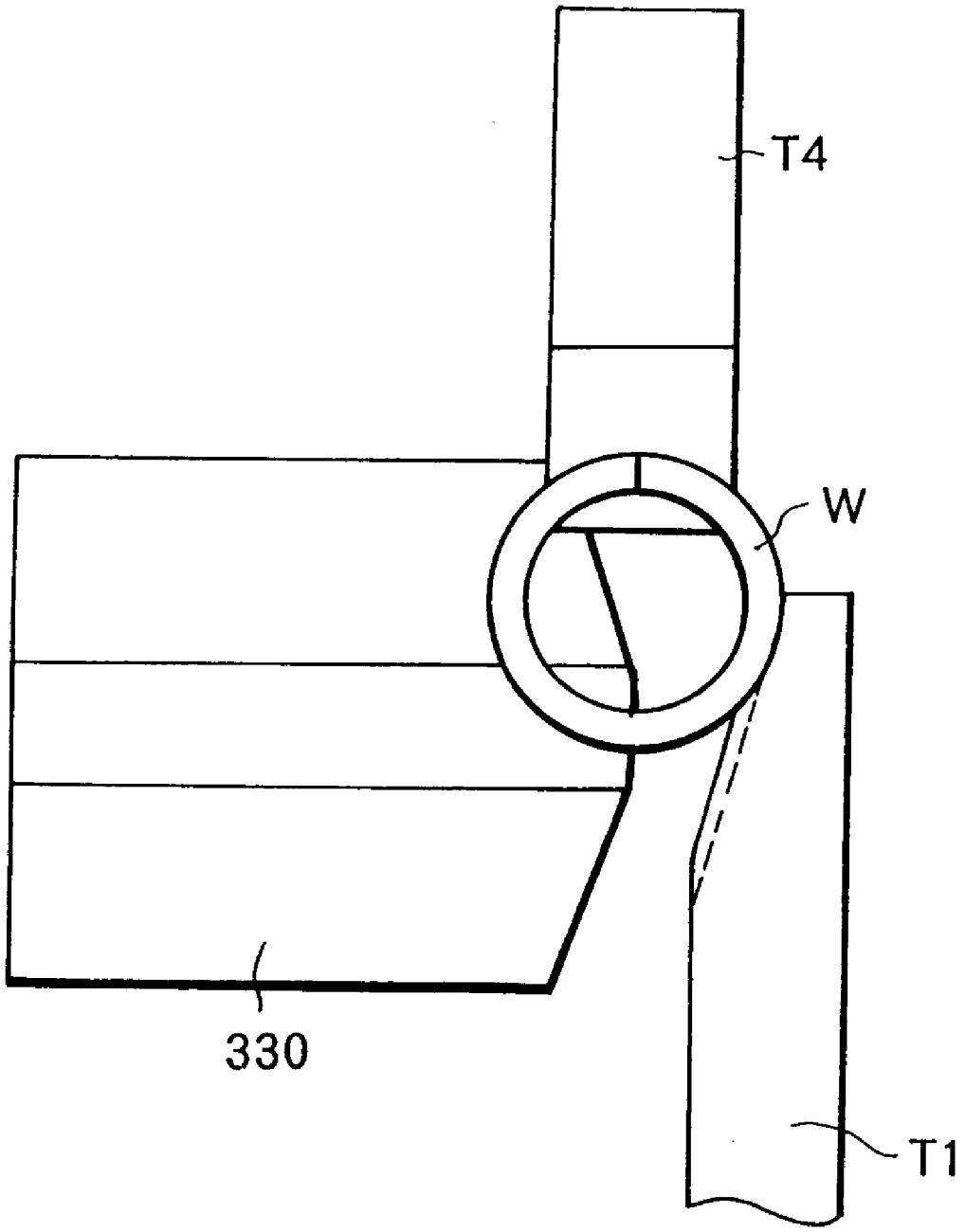
FIG. 25 is a view showing the pitched coiling process in three-dimensional forming.

FIGS. 24 and 25 show a pitched coiling process in three-dimensional forming.

When a pitched coiling process is to be performed in three-dimensional forming, the wire W is pushed out to forcibly bring it into contact with the end portion of the abutment tool T1 and wind it on the inclined surface of the wire guide 330. During this operation, a pitch tool T4 is interposed to provide pitches between coil elements, thereby forming, for example, a coil portion of a spring. This pitched coiling process allows easy setting of pitches in coil forming.

Figure 26:
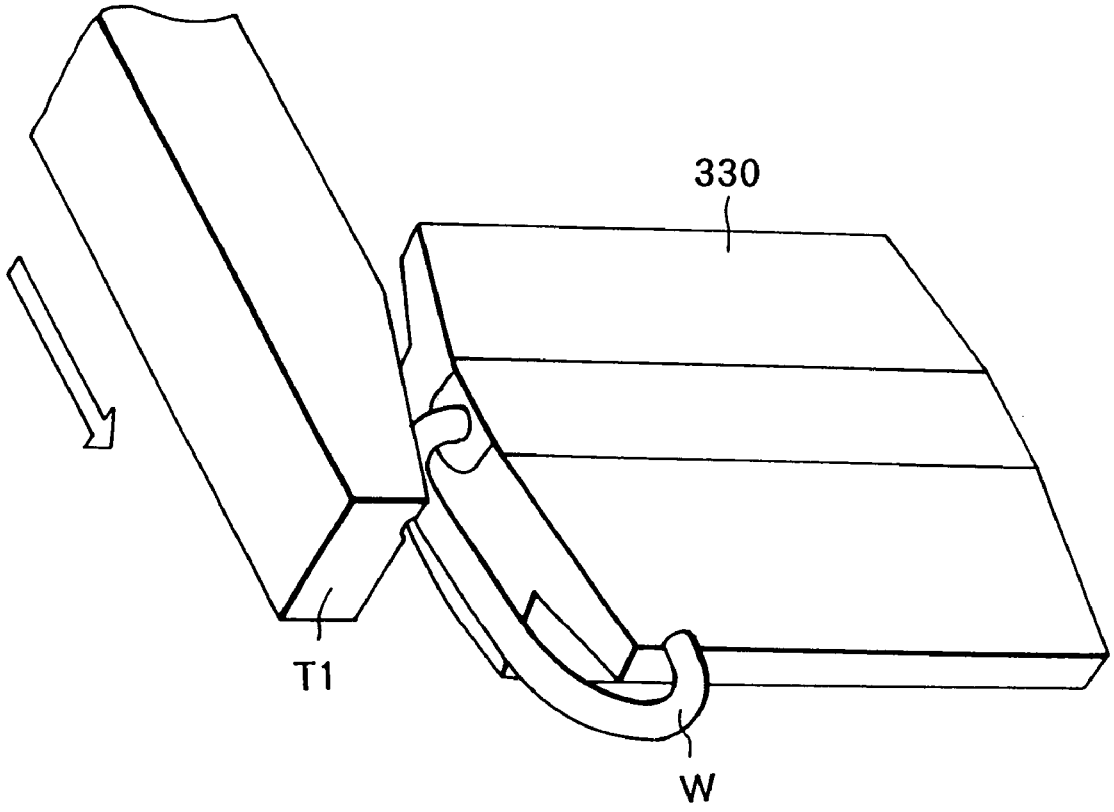
FIG. 26 is a view showing a hook raise process in three-dimensional forming.
Figure 27:
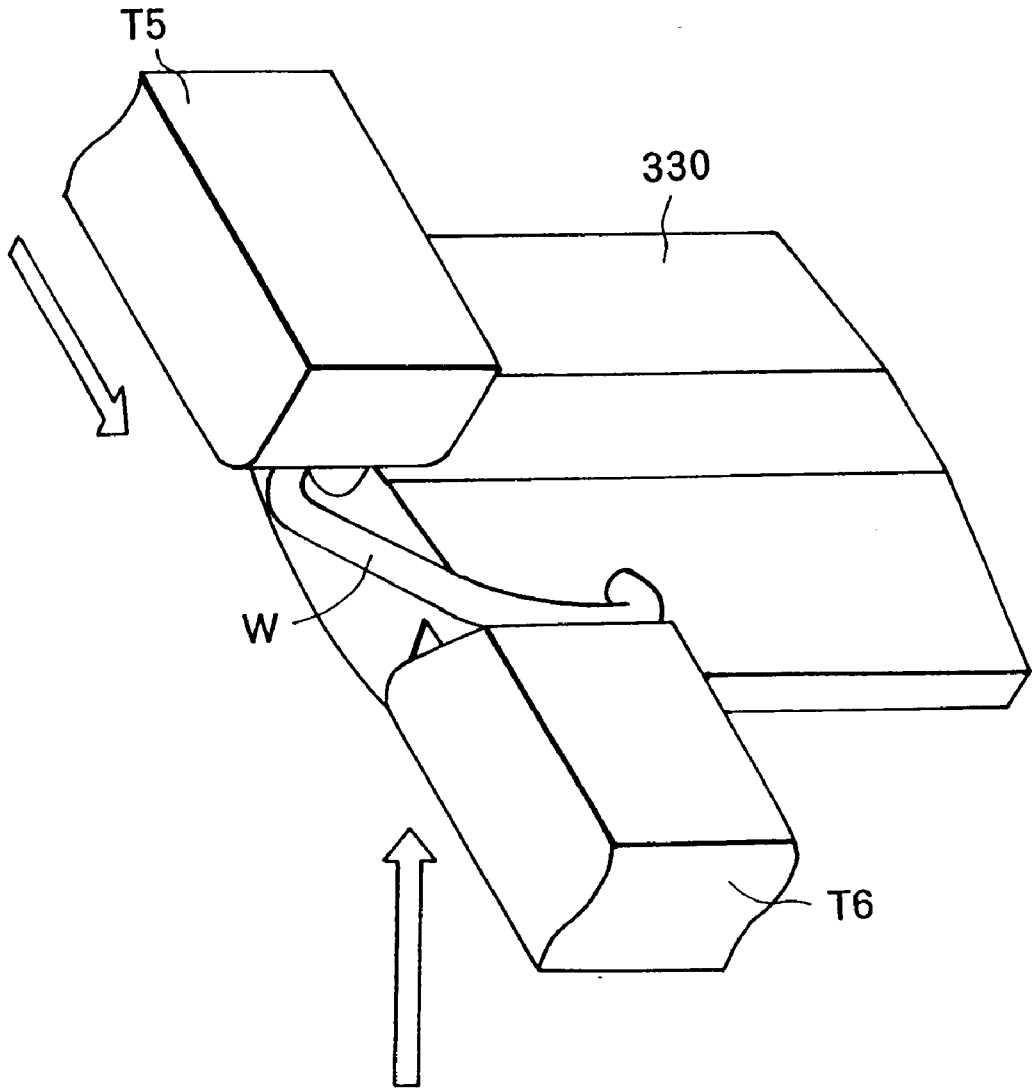
FIG. 27 is a view showing the hook raise process in three-dimensional forming.
Figure 28:
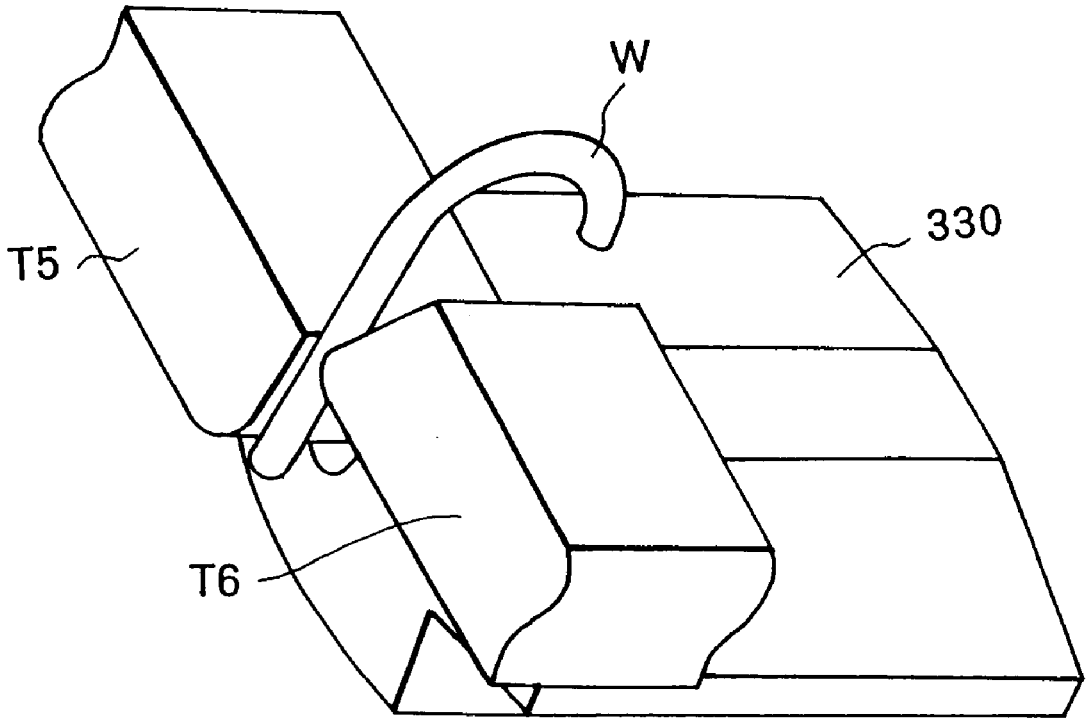
FIG. 28 is a view showing the hook raise process in three-dimensional forming.

FIGS. 26 to 28 show a hook raise processing in three-dimensional forming.

In a hook raise process, the hook portion that has already been formed by the rotating tool T2 or abutment tool T1 by two-dimensional forming is further bent into a three-dimensional shape by using hook raise tools T5 and T6.

When a hook raise process is to be performed in three-dimensional forming, the hook portion obtained by two-dimensional forming by pushing out the wire W and forcibly bringing it into contact with the end portion of the abutment tool T1 is bent into a three-dimensional shape.

Figure 29:
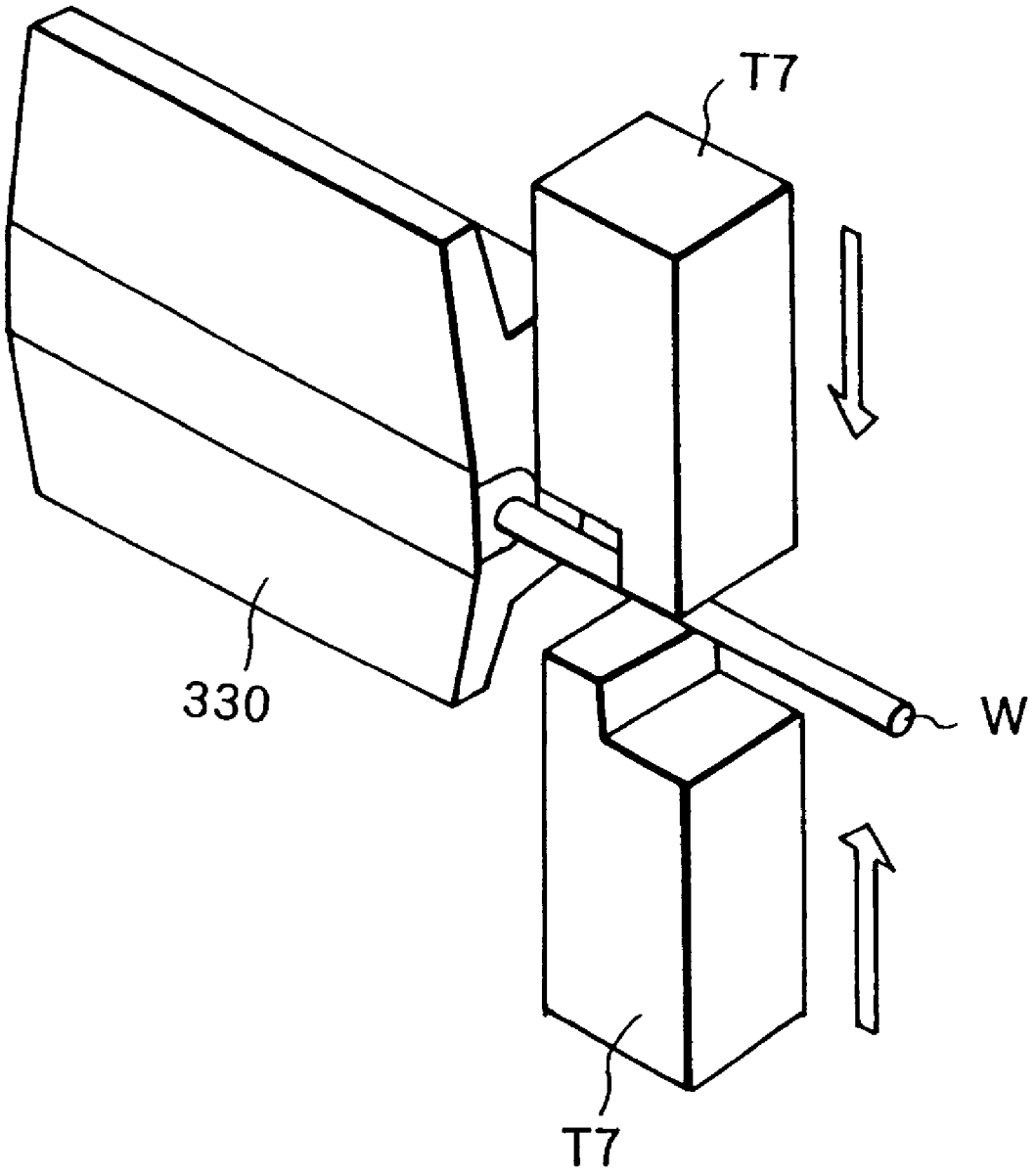
FIG. 29 is a view showing press forming.
Figure 30:
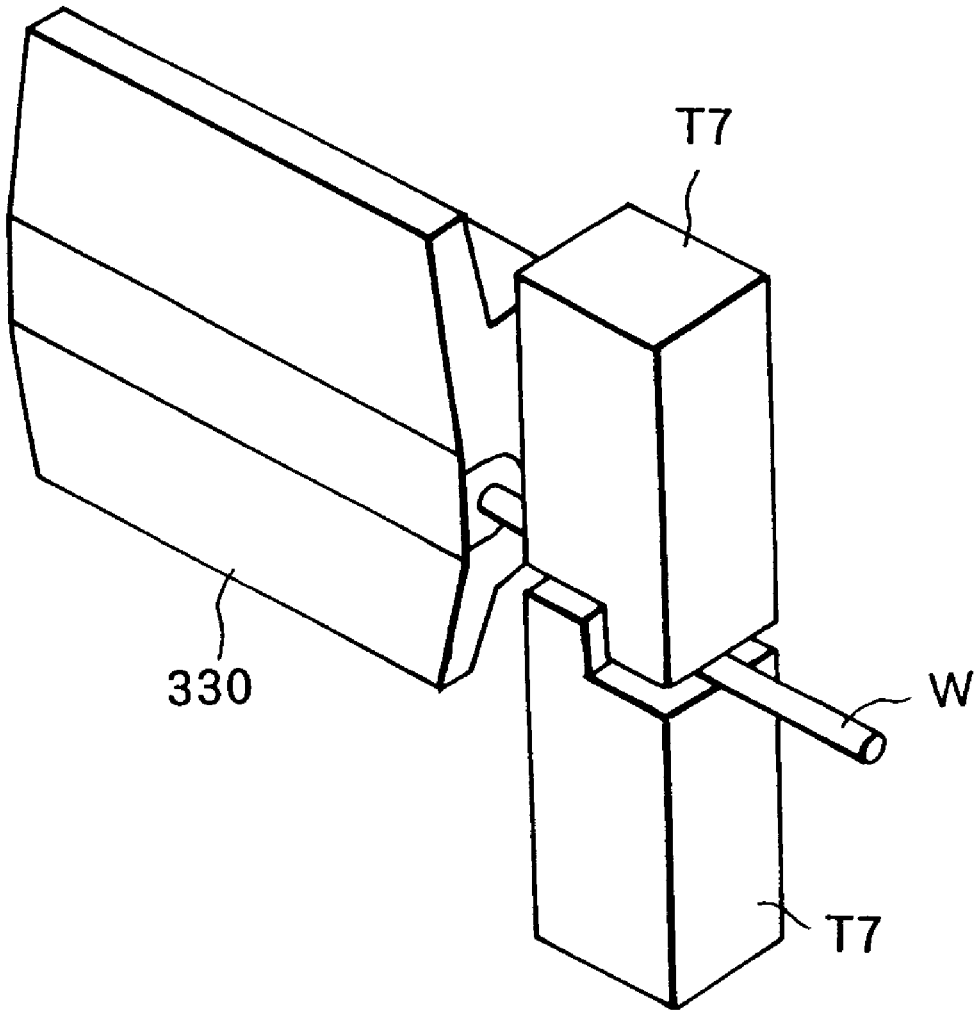
FIG. 30 is a view showing press forming.
Figure 31:
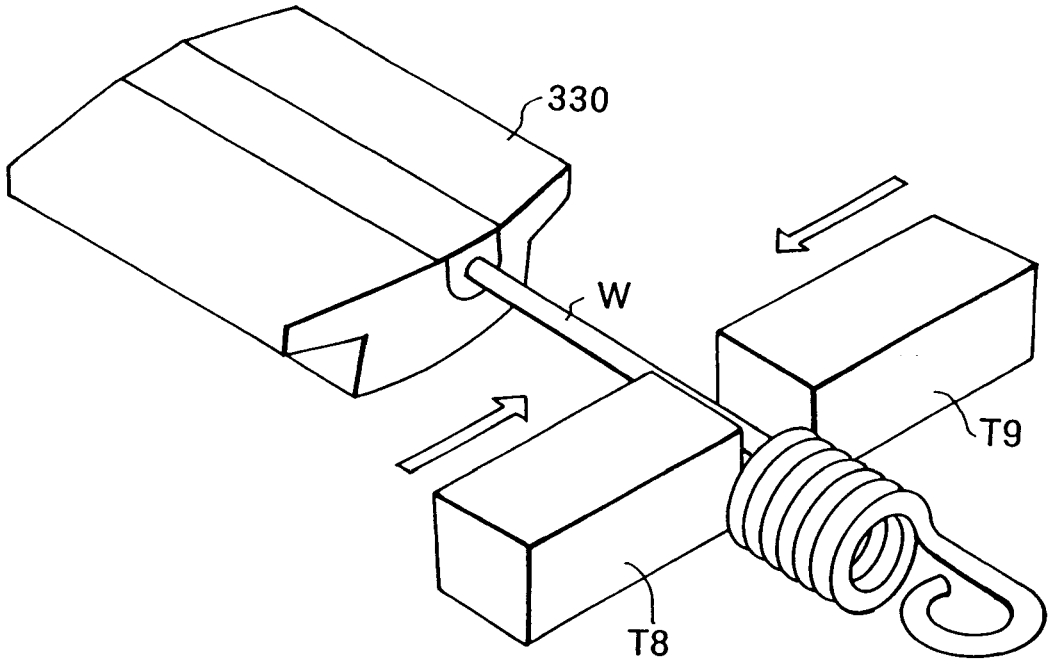
FIG. 31 is a view showing cutting and tool bending after cutting.
Figure 32:
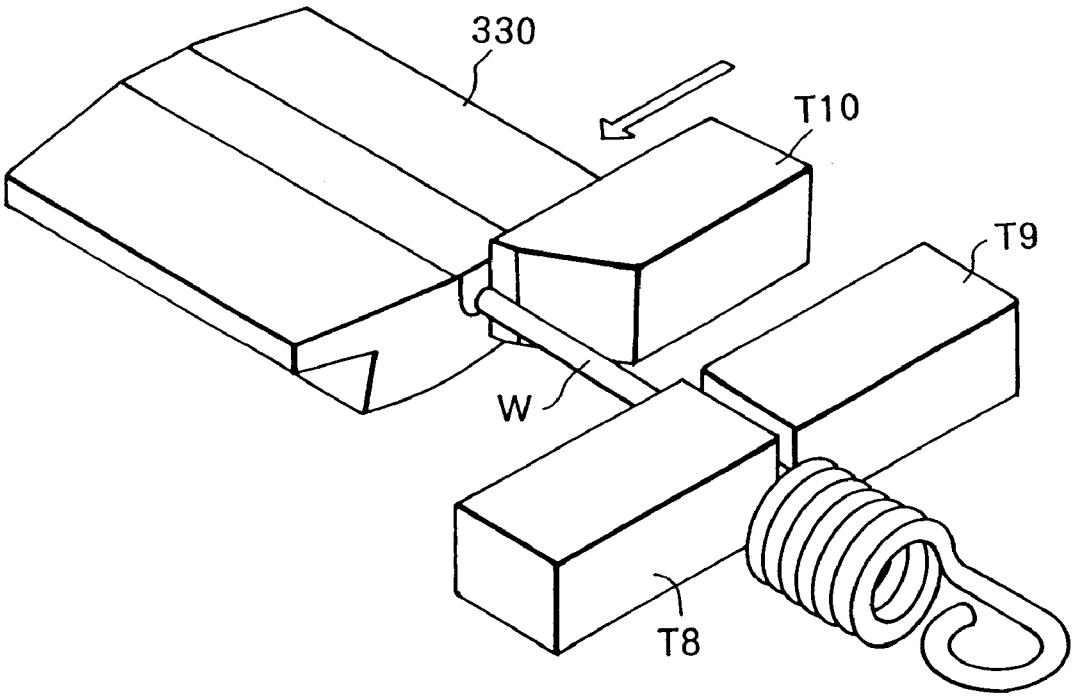
FIG. 32 is a view showing cutting and tool bending after cutting.
Figure 33:
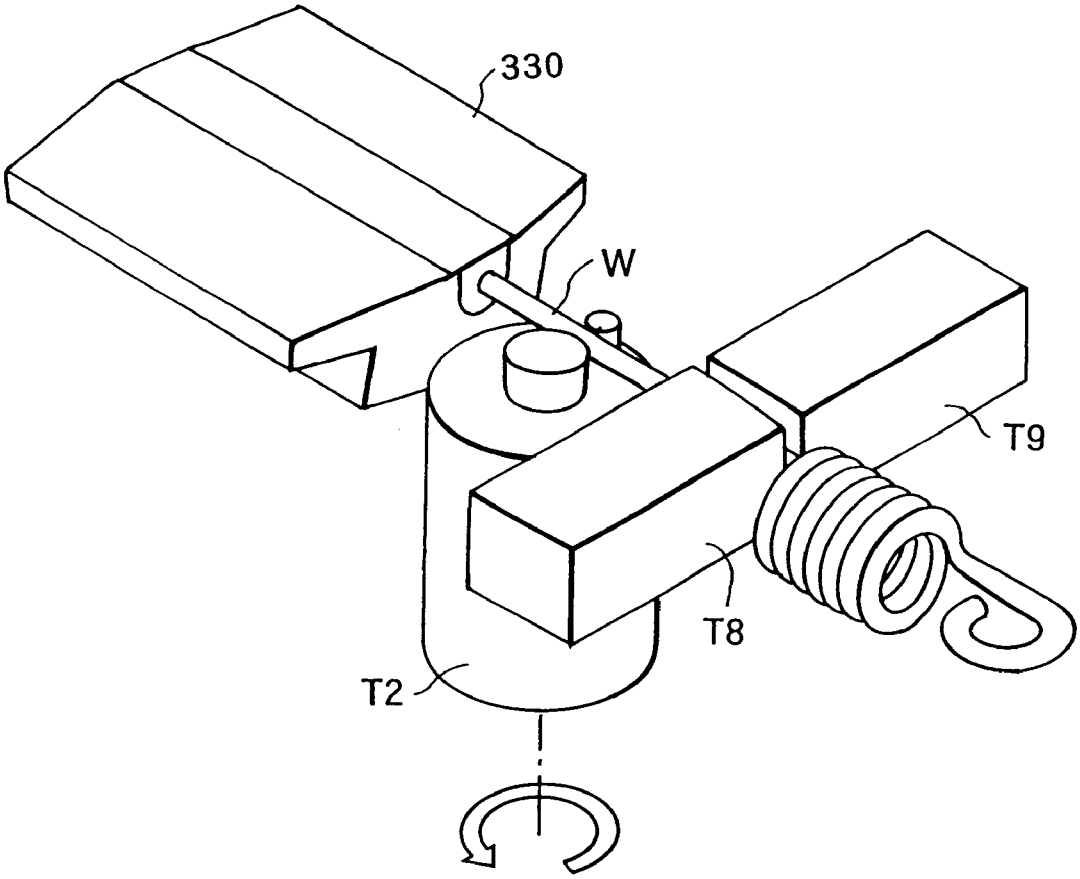
FIG. 33 is a view showing cutting and tool bending after cutting.
Figure 34:
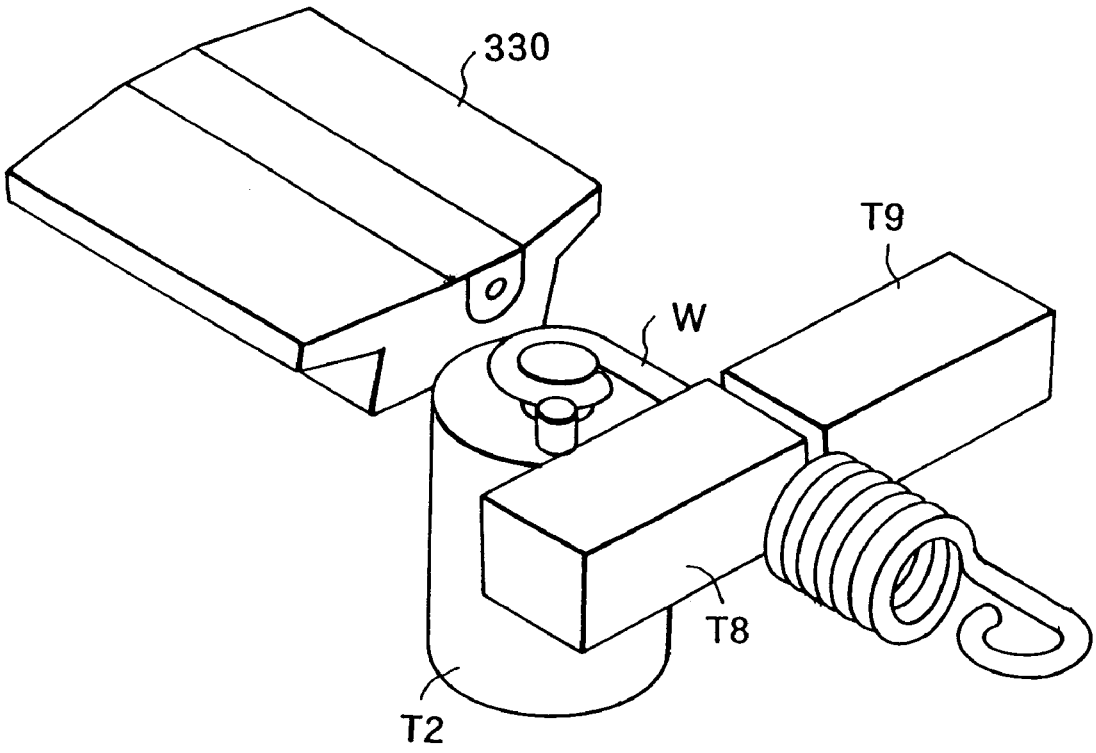
FIG. 34 is a view showing cutting and tool bending after cutting.

FIGS. 29 and 30 show press forming.

In press forming, the wire W is clamped between opposing crank bending tools T7 to be formed into a crank-like shape or the like.

When press forming is to be performed, the opposing press tools T7 are slid upward/downward by crank mechanisms to clamp and bend the wire W. This press forming is used to form the wire W into a special shape.

FIGS. 31 to 34 show cutting and tool bending after cutting.

When cutting is to be performed, the wire W is clamped between opposing holding tools T8 and T9, and a cutting tool T10 is slid to cut the wire.

When the cut portion is to be bent, it is done by using the rotating tool T2 according to the procedure described with reference to FIGS. 16 and 17.

As described above, in two-dimensional forming, since one tool is driven, a fine adjustment on the position of the tool with respect to a wire can be automatically made by using the swing support structure.

In three-dimensional forming, press forming, and other kinds of special forming, since two or more tools are simultaneously driven, if a plurality of tools simultaneously swing, some problems may arise. For this reason, some tools may be fixed so as not to swing by removing the bridges 407.

Arrangement of Controller

The arrangement of a controller for the spring manufacturing apparatus according to this embodiment will be described next.

Figure 35:
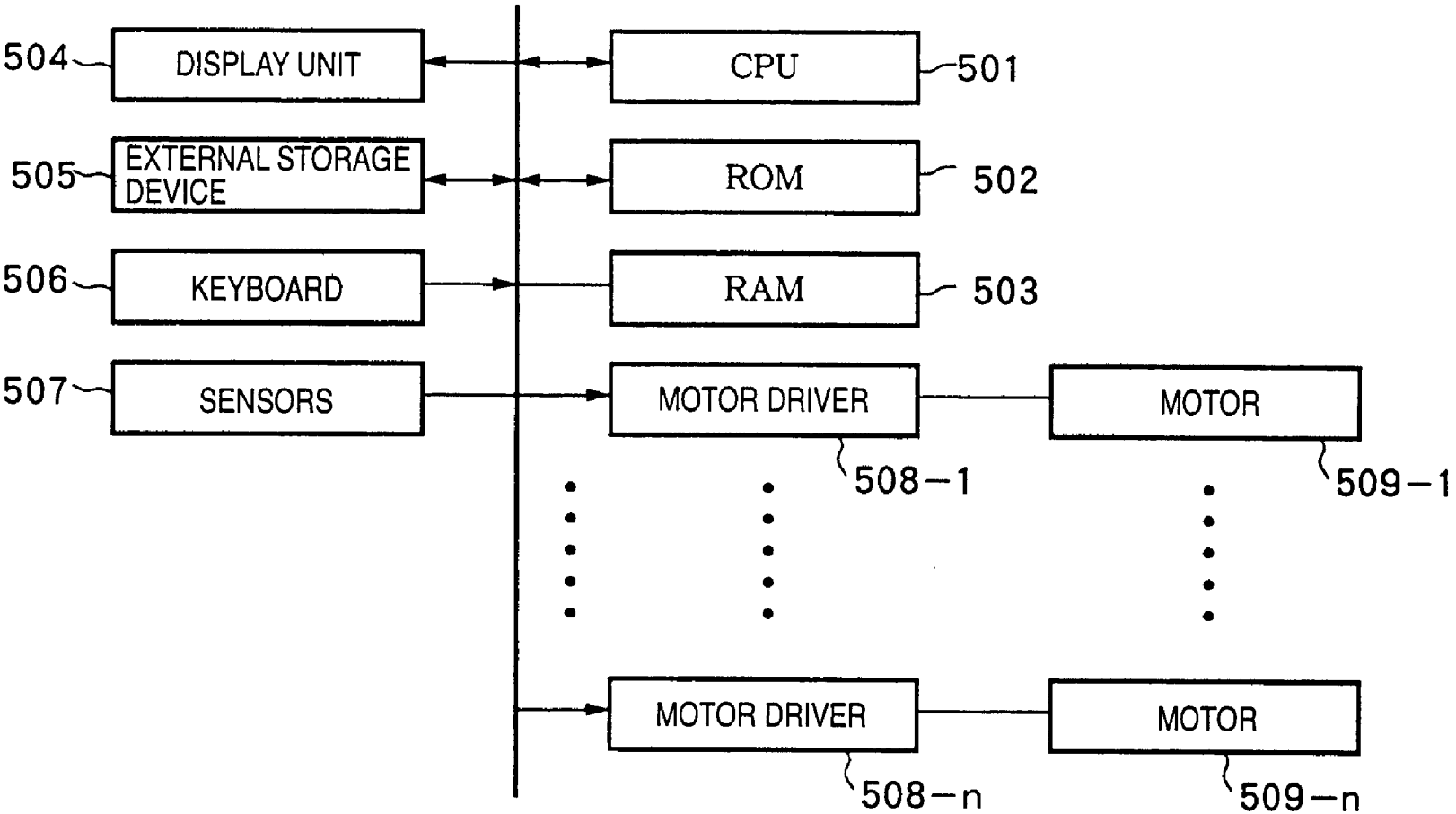
FIG. 35 is a block diagram showing the arrangement of a controller for the spring manufacturing apparatus.

FIG. 35 is a block diagram showing the arrangement of a controller for the spring manufacturing apparatus.

As shown in FIG. 35, a CPU 501 controls the overall controller. A ROM 502 stores processing contents (programs) of the CPU 501 and various font data. A RAM 503 is used as a work area of the CPU 501. A display unit 504 is used to perform various settings, display the contents of the settings, and also display a manufacturing process and the like in the form of graphs. An external storage device 505 is a floppy disk drive or the like and used to externally supply a program or store various setting contents for wire forming. With this arrangement, for example, by storing parameters for a given forming process (e.g., for a spring, its free length, diameter, and the like) in advance, springs having the same shape can always be manufactured by setting the floppy disk and executing the program.

A keyboard 506 is used to set various parameters. Sensors 507 are used to detect the feed amount of wire, the free length of a spring, and the like.

Motors 508-1 to 508-n include a motor for driving the wire feed roller pair 320, a motor for rotating the wire feed roller pair 320 and wire guide 330, and a motor for driving the swing ring. The motors 508-1 to 508-n are respectively driven by motor drivers 509-1 to 509-n.

In this control block, the CPU 501, for example, independently drives the respective motors, input/output data to/from the external storage device 505, and controls the display unit 504 in accordance with instructions input through the keyboard 506.

The present invention is not limited to the above embodiments and various changes and modifications can be made within the spirit and scope of the present invention. Therefore, to apprise the public of the scope of the present invention the following claims are made.

What is claimed is:

1. A spring manufacturing apparatus for manufacturing a spring by feeding a wire to be formed into a spring out of an end portion of a wire guide, and forcibly bending, curving, or winding the wire by using a tool in a spring forming space near an end portion of the wire guide,comprising:

a plurality of tools arranged to extend radially with respect to wires fed into the spring forming spaces and to be slidable toward the wires fed into the spring forming spaces;

a rotating ring member for supporting the end portion of at least one of said tools to allow the end portion of at least one of said tools to simultaneously swing with respect to the wires fed out from the end portions of the wire guides; and a driving means for rotatably driving said rotating ring member at a predetermined angle around the wire fed out from the end portion of the wire guide.

* * * * *

UNITED STATES PATENT AND TRADEMARK OFFICE

CERTIFICATE OF CORRECTION

PATENT NO. : 6,701,765 B2
DATED : March 9, 2004
INVENTOR(S) : Itaya

It is certified that error appears in the above-identified patent and that said Letters Patent is hereby corrected as shown below:

Column 1,
Line 35, "spaces, supported" should read -- spaces, are supported --
Lines 36 and 37, "and supported to allow" should read -- and are supported to allow --

Column 3,
Line 45, "cutting wires radially" should read -- cutting wires, radially --

Column 4,
Line 46, "and outer ring" should read -- and an outer ring --

Column 7,
Line 11, "wire guide,comprising:" should read -- wire guide, comprising: --
Line 13, "wires fed into the spring forming spaces and" should read -- the wire fed into the spring forming space, said tools being supported by tool sliders so as --

Column 8,
Lines 1-2, "to be slidable toward the wires fed into the spring forming spaces;" should read -- to slide toward the wire fed into the spring forming space, wherein first ends of said sliders located far from the wire are rotatably supported by a base table; --
Lines 3-7, "a rotating ring member for supporting the end portion of at least one of said tools to allow the end portion of at least one of said tools to simultaneously swing with respect to the wires fed out from the end portions portion of the wire guides; and" should read -- a rotating ring member supporting second ends of the sliders near the wire, which are connected by the ring member, to allow an end portion of at least one of said tools to swing with respect to the wire fed out from the end portion of the wire guide and adjust offset amount of the end portion of the at least one of said tools with respect to the direction perpendicular to the wire feeding direction; and --

UNITED STATES PATENT AND TRADEMARK OFFICE

CERTIFICATE OF CORRECTION

PATENT NO. : 6,701,765 B2
DATED : March 9, 2004
INVENTOR(S) : Itaya

It is certified that error appears in the above-identified patent and that said Letters Patent is hereby corrected as shown below:

Column 8 (cont'd),
Line 9, "member at a predetermined" should read -- member on the base table at a predetermined --

Signed and Sealed this

Twelfth Day of April, 2005

JON W. DUDAS
*Director of the United States Patent and Trademark Office*